US007070253B2

(12) United States Patent
Yashima et al.

(10) Patent No.: US 7,070,253 B2
(45) Date of Patent: Jul. 4, 2006

(54) INK-JET PRINTING METHOD AND APPARATUS

(75) Inventors: Masataka Yashima, Tokyo (JP); Tsuyoshi Shibata, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/932,112

(22) Filed: Sep. 2, 2004

(65) Prior Publication Data

US 2005/0024408 A1 Feb. 3, 2005

Related U.S. Application Data

(62) Division of application No. 10/339,286, filed on Jan. 10, 2003, now Pat. No. 6,854,822.

(30) Foreign Application Priority Data

Jan. 16, 2002 (JP) ..... 2002-007858
Jan. 16, 2002 (JP) ..... 2002-007859

(51) Int. Cl.
*B41J 2/205* (2006.01)

(52) U.S. Cl. ..... 347/15; 347/19; 347/43

(58) Field of Classification Search ..... 347/15, 347/19, 41, 43; 358/455, 458
See application file for complete search history.

(56) References Cited

U.S. PATENT DOCUMENTS

| | | | | |
|---|---|---|---|---|
| 4,313,124 | A | 1/1982 | Hara | 347/57 |
| 4,345,262 | A | 8/1982 | Shirato et al. | 347/10 |
| 4,459,600 | A | 7/1984 | Sato et al. | 347/47 |
| 4,463,359 | A | 7/1984 | Ayata et al. | 347/56 |
| 4,558,333 | A | 12/1985 | Sugitani et al. | 347/65 |
| 4,723,129 | A | 2/1988 | Endo et al. | 347/56 |
| 4,740,796 | A | 4/1988 | Endo et al. | 347/56 |
| 4,849,774 | A | 7/1989 | Endo et al. | 347/56 |
| 5,121,446 | A | 6/1992 | Yamada et al. | 382/50 |
| 6,164,747 | A | 12/2000 | Yashima et al. | 347/15 |
| 6,854,822 | B1 * | 2/2005 | Yashima et al. | 347/15 |
| 2002/0039118 | A1 | 4/2002 | Shibata | 347/15 |

FOREIGN PATENT DOCUMENTS

| | | |
|---|---|---|
| EP | 0 750 995 | 1/1997 |
| EP | 0 942 591 | 9/1999 |

(Continued)

OTHER PUBLICATIONS

Floyd, et al., "An Adaptive Algorithm for Spatial Greyscale," Proceedings of the Society for Information Display, vol. 17, No. 2, Second Quarter 1976, pp. 62, 75-77.

*Primary Examiner*—Hai Pham
*Assistant Examiner*—Lam S. Nguyen
(74) *Attorney, Agent, or Firm*—Fitzpatrick, Cella, Harper & Scinto

(57) ABSTRACT

When multilevel printing is performed by using a plurality of types of inks, which present different densities for similar colors when used for printing, and changing the types of inks and the numbers of ink droplets in printing each pixel, an ink distribution table which defines a combination of the types of inks and the numbers of ink droplets in correspondence with each gray level value is generated on the basis of input information associated with the relative densities of the respective inks. A combination to be used to print each pixel is selected on the basis of the ink distribution table, thereby printing a good grayscale image free from gray-level reversal and the like.

13 Claims, 22 Drawing Sheets

FOREIGN PATENT DOCUMENTS

| | | |
|---|---|---|
| JP | 54-59936 | 5/1979 |
| JP | 59-123670 | 7/1984 |
| JP | 59-138461 | 8/1984 |
| JP | 2-210962 | 8/1990 |
| JP | 10-324002 | 12/1998 |

* cited by examiner

FIG. 3

| ROW D3 | * | | * | | * | | X=+1 | | X=0 | | X=-1 | | * | | * | | * | |
|---|---|---|---|---|---|---|---|---|---|---|---|---|---|---|---|---|---|---|
| | a | b | a | b | a | b | a | b | a | b | a | b | a | b | a | b | a | b |
| D1 | | | | | | | 0 | 3 | 0 | 2 | 0 | 1 | | | | | | |
| D2 | | | | | | | 4 | 0 | 4 | 1 | 4 | 2 | | | | | | |
| D3 | | | | | | | 0 | 1 | 0 | 1 | 0 | 1 | | | | | | |
| D4 | | | | | | | 0 | 0 | 0 | 0 | 0 | 0 | | | | | | |
| D5 | | | | | | | 0 | 0 | 0 | 0 | 0 | 0 | | | | | | |
| D6 | | | | | | | 0 | 0 | 0 | 0 | 0 | 0 | | | | | | |
| ROW D4 | 3+X | | 2+X | | 1+X | | 0+X | | 0 | | -1 | | -2 | | -3 | | -4 | |
| | a | b | a | b | a | b | a | b | a | b | a | b | a | b | a | b | a | b |
| D1 | 0 | 3 | 0 | 2 | 0 | 1 | 0 | 0 | 0 | 2 | 2 | 3 | 2 | 2 | 2 | 1 | 2 | 0 |
| D2 | 1 | 0 | 1 | 1 | 1 | 2 | 1 | 3 | 1 | 0 | 0 | 0 | 0 | 1 | 0 | 2 | 0 | 3 |
| D3 | 3 | 0 | 3 | 0 | 3 | 0 | 3 | 0 | 3 | 1 | 2 | 0 | 2 | 0 | 2 | 0 | 2 | 0 |
| D4 | 0 | 1 | 0 | 1 | 0 | 1 | 0 | 1 | 0 | 1 | 0 | 1 | 0 | 1 | 0 | 1 | 0 | 1 |
| D5 | 0 | 0 | 0 | 0 | 0 | 0 | 0 | 0 | 0 | 0 | 0 | 0 | 0 | 0 | 0 | 0 | 0 | 0 |
| D6 | 0 | 0 | 0 | 0 | 0 | 0 | 0 | 0 | 0 | 0 | 0 | 0 | 0 | 0 | 0 | 0 | 0 | 0 |
| ROW D5 | 3+X | | 2+X | | 1+X | | 0+X | | 0 | | -1 | | -2 | | -3 | | -4 | |
| | a | b | a | b | a | b | a | b | a | b | a | b | a | b | a | b | a | b |
| D1 | 0 | 3 | 0 | 2 | 0 | 1 | 0 | 0 | 0 | 2 | 2 | 2 | 2 | 2 | 2 | 1 | 2 | 0 |
| D2 | 1 | 0 | 1 | 1 | 1 | 2 | 1 | 3 | 1 | 0 | 0 | 0 | 0 | 1 | 0 | 2 | 0 | 3 |
| D3 | 1 | 0 | 1 | 0 | 1 | 0 | 1 | 0 | 1 | 1 | 0 | 0 | 0 | 0 | 0 | 0 | 0 | 0 |
| D4 | 2 | 0 | 2 | 0 | 2 | 0 | 2 | 0 | 2 | 0 | 2 | 0 | 2 | 0 | 2 | 0 | 2 | 0 |
| D5 | 0 | 1 | 0 | 1 | 0 | 1 | 0 | 1 | 0 | 1 | 0 | 1 | 0 | 1 | 0 | 1 | 0 | 1 |
| D6 | 0 | 0 | 0 | 0 | 0 | 0 | 0 | 0 | 0 | 0 | 0 | 0 | 0 | 0 | 0 | 0 | 0 | 0 |
| ROW D6 | 3+X | | 2+X | | 1+X | | 0+X | | 0 | | -1 | | -2 | | -3 | | -4 | |
| | a | b | a | b | a | b | a | b | a | b | a | b | a | b | a | b | a | b |
| D1 | 0 | 3 | 0 | 2 | 0 | 1 | 0 | 0 | 0 | 2 | 2 | 3 | 2 | 2 | 2 | 1 | 2 | 0 |
| D2 | 1 | 0 | 1 | 1 | 1 | 2 | 1 | 3 | 1 | 0 | 0 | 0 | 0 | 1 | 0 | 2 | 0 | 3 |
| D3 | 1 | 0 | 1 | 0 | 1 | 0 | 1 | 0 | 1 | 1 | 0 | 0 | 0 | 0 | 0 | 0 | 0 | 0 |
| D4 | 0 | 0 | 0 | 0 | 0 | 0 | 0 | 0 | 0 | 0 | 0 | 0 | 0 | 0 | 0 | 0 | 0 | 0 |
| D5 | 2 | 0 | 2 | 0 | 2 | 0 | 2 | 0 | 2 | 0 | 2 | 0 | 2 | 0 | 2 | 0 | 2 | 0 |
| D6 | 0 | 1 | 0 | 1 | 0 | 1 | 0 | 1 | 0 | 1 | 0 | 1 | 0 | 1 | 0 | 1 | 0 | 1 |

FIG. 4

| I.D. | D1 | D2 | D3 | D4 | D5 | D6 | PRIORITY LEVEL | SUM (b) |
|---|---|---|---|---|---|---|---|---|
| 0 | 0 | 0 | 0 | 0 | 0 | 0 | 0 | 0 |
| 1 | 1 | 0 | 0 | 0 | 0 | 0 | 1 | 1 |
| 2 | 2 | 0 | 0 | 0 | 0 | 0 | 2 | 2 |
| 3 | 1 | 1 | 0 | 0 | 0 | 0 | 3 | 3 |
| 4 | 2 | 1 | 0 | 0 | 0 | 0 | 4 | 4 |
| 5 | 1 | 2 | 0 | 0 | 0 | 0 | 5 | 5 |
| 6 | 2 | 0 | 1 | 0 | 0 | 0 | 6 | 6 |
| 7 | 1 | 1 | 1 | 0 | 0 | 0 | 7 | 7 |
| 8 | 2 | 1 | 1 | 0 | 0 | 0 | 8 | 8 |
| 9 | 1 | 2 | 1 | 0 | 0 | 0 | 9 | 9 |
| 10 | 0 | 3 | 1 | 0 | 0 | 0 | 10 | 10 |
| 11 | 1 | 1 | 2 | 0 | 0 | 0 | 11 | 11 |
| 12 | 0 | 2 | 2 | 0 | 0 | 0 | 12 | 12 |
| 13 | 1 | 0 | 3 | 0 | 0 | 0 | 13 | 13 |
| 14 | 2 | 0 | 1 | 1 | 0 | 0 | 14 | 15 |
| 15 | 1 | 1 | 1 | 1 | 0 | 0 | 15 | 16 |
| 16 | 0 | 2 | 1 | 1 | 0 | 0 | 16 | 17 |
| 17 | 1 | 0 | 2 | 1 | 0 | 0 | 17 | 18 |
| 18 | 0 | 1 | 2 | 1 | 0 | 0 | 18 | 19 |
| 19 | 3 | 0 | 0 | 0 | 1 | 0 | 19 | 20 |
| 20 | 2 | 1 | 0 | 0 | 1 | 0 | 20 | 21 |
| ... | ... | ... | ... | ... | ... | ... | ... | ... |
| 40 | 2 | 0 | 0 | 0 | 1 | 1 | 40 | 52 |
| 41 | 0 | 2 | 0 | 0 | 1 | 1 | 41 | 54 |
| 42 | 0 | 1 | 1 | 0 | 1 | 1 | 42 | 56 |
| 43 | 1 | 0 | 0 | 1 | 1 | 1 | 43 | 60 |
| 44 | 0 | 0 | 1 | 1 | 1 | 1 | 44 | 63 |
| 45 | 0 | 0 | 0 | 2 | 1 | 1 | 45 | 68 |
| 46 | 0 | 0 | 1 | 0 | 2 | 1 | 46 | 71 |
| 47 | 0 | 0 | 0 | 1 | 2 | 1 | 47 | 76 |
| 48 | 0 | 0 | 1 | 1 | 0 | 2 | 48 | 79 |
| 49 | 0 | 0 | 0 | 2 | 0 | 2 | 49 | 84 |
| 50 | 0 | 0 | 1 | 0 | 1 | 2 | 50 | 87 |
| 51 | 0 | 0 | 0 | 1 | 1 | 2 | 51 | 92 |
| 52 | 0 | 0 | 0 | 0 | 2 | 2 | 52 | 100 |
| 53 | 0 | 0 | 0 | 1 | 0 | 3 | 53 | 108 |
| 54 | 0 | 0 | 0 | 0 | 1 | 3 | 54 | 116 |
| 55 | 0 | 0 | 0 | 0 | 0 | 4 | 55 | 132 |
| 56 | 0 | 1 | 0 | 0 | 0 | 0 | | 2 |
| 57 | 0 | 0 | 1 | 0 | 0 | 0 | | 4 |
| 58 | 0 | 2 | 0 | 0 | 0 | 0 | | 4 |
| 59 | 1 | 0 | 1 | 0 | 0 | 0 | | 5 |
| 60 | 0 | 1 | 1 | 0 | 0 | 0 | | 6 |
| 61 | 0 | 3 | 0 | 0 | 0 | 0 | | 6 |
| 62 | 0 | 0 | 2 | 0 | 0 | 0 | | 8 |
| 63 | 0 | 2 | 1 | 0 | 0 | 0 | | 8 |
| 64 | 1 | 0 | 2 | 0 | 0 | 0 | | 9 |
| 65 | 1 | 0 | 0 | 1 | 0 | 0 | | 10 |
| 66 | 0 | 1 | 2 | 0 | 0 | 0 | | 10 |
| 67 | 2 | 0 | 2 | 0 | 0 | 0 | | 10 |
| 68 | 0 | 1 | 0 | 1 | 0 | 0 | | 11 |
| 69 | 2 | 0 | 0 | 1 | 0 | 0 | | 11 |
| ... | ... | ... | ... | ... | ... | ... | ... | ... |
| 177 | 0 | 0 | 0 | 0 | 1 | 2 | | 83 |
| 178 | 0 | 0 | 0 | 0 | 3 | 1 | | 84 |
| 179 | 1 | 0 | 0 | 0 | 1 | 2 | | 84 |
| 180 | 0 | 1 | 0 | 0 | 1 | 2 | | 85 |
| 181 | 0 | 0 | 0 | 0 | 0 | 3 | | 99 |
| 182 | 1 | 0 | 0 | 0 | 0 | 3 | | 100 |
| 183 | 0 | 1 | 0 | 0 | 0 | 3 | | 101 |
| 184 | 0 | 0 | 1 | 0 | 0 | 3 | | 103 |

a

FIG. 6

| DENSITY LEVEL | D1 | D2 | D3 | D4 | D5 | D6 |
|---|---|---|---|---|---|---|
| 0 | 0 | 0 | 0 | 0 | 0 | 0 |
| 46 | 1 | 0 | 0 | 0 | 0 | 0 |
| 91 | 2 | 0 | 0 | 0 | 0 | 0 |
| | 0 | 1 | 0 | 0 | 0 | 0 |
| 136 | 1 | 1 | 0 | 0 | 0 | 0 |
| 180 | 2 | 1 | 0 | 0 | 0 | 0 |
| | 0 | 2 | 0 | 0 | 0 | 0 |
| | 0 | 0 | 1 | 0 | 0 | 0 |
| 224 | 1 | 2 | 0 | 0 | 0 | 0 |
| | 1 | 0 | 1 | 0 | 0 | 0 |
| 268 | 2 | 0 | 1 | 0 | 0 | 0 |
| | 0 | 3 | 0 | 0 | 0 | 0 |
| | 0 | 1 | 1 | 0 | 0 | 0 |
| 312 | 1 | 1 | 1 | 0 | 0 | 0 |
| 355 | 2 | 1 | 1 | 0 | 0 | 0 |
| | 0 | 2 | 1 | 0 | 0 | 0 |
| | 0 | 0 | 2 | 0 | 0 | 0 |
| 398 | 1 | 2 | 1 | 0 | 0 | 0 |
| | 1 | 0 | 2 | 0 | 0 | 0 |
| 440 | 0 | 3 | 1 | 0 | 0 | 0 |
| | 2 | 0 | 2 | 0 | 0 | 0 |
| | 0 | 1 | 2 | 0 | 0 | 0 |
| | 1 | 0 | 0 | 1 | 0 | 0 |
| 482 | 1 | 1 | 2 | 0 | 0 | 0 |
| | 2 | 0 | 0 | 1 | 0 | 0 |
| | 0 | 1 | 0 | 1 | 0 | 0 |
| 524 | 0 | 2 | 2 | 0 | 0 | 0 |
| | 3 | 0 | 0 | 1 | 0 | 0 |
| ... | ... | ... | ... | ... | ... | ... |
| 2404 | 0 | 0 | 1 | 1 | 1 | 1 |
| 2568 | 0 | 0 | 0 | 2 | 1 | 1 |
| | 1 | 0 | 0 | 0 | 2 | 1 |
| | 2 | 0 | 0 | 0 | 0 | 2 |
| | 0 | 1 | 0 | 0 | 0 | 2 |
| 2665 | 0 | 0 | 1 | 0 | 2 | 1 |
| | 1 | 0 | 1 | 0 | 0 | 2 |
| 2822 | 0 | 0 | 0 | 1 | 2 | 1 |
| | 1 | 0 | 0 | 1 | 0 | 2 |
| 2915 | 0 | 0 | 1 | 1 | 0 | 2 |
| 3065 | 0 | 0 | 0 | 2 | 0 | 2 |
| | 0 | 0 | 0 | 0 | 3 | 1 |
| | 1 | 0 | 0 | 0 | 1 | 2 |
| 3152 | 0 | 0 | 1 | 0 | 1 | 2 |
| 3294 | 0 | 0 | 0 | 1 | 1 | 2 |
| 3506 | 0 | 0 | 0 | 0 | 2 | 2 |
| | 1 | 0 | 0 | 0 | 0 | 3 |
| 3697 | 0 | 0 | 0 | 1 | 0 | 3 |
| 3862 | 0 | 0 | 0 | 0 | 1 | 3 |
| 4095 | 0 | 0 | 0 | 0 | 0 | 4 |

FIG. 13

| | Z1 | Z2 | Z3 | Z4 | Z5 | Z6 | Z7 | Z8 | Z9 | Z10 | Z11 | Z12 |
|---|---|---|---|---|---|---|---|---|---|---|---|---|
| D1 | 2 | 0 | 2 | 0 | 0 | 0 | 2 | 0 | 0 | 1 | 0 | 0 |
| D2 | 0 | 2 | 0 | 2 | 1 | 0 | 0 | 2 | 1 | 0 | 0 | 0 |
| D3 | 1 | 1 | 0 | 0 | 1 | 2 | 0 | 0 | 1 | 0 | 1 | 0 |
| D4 | 0 | 0 | 1 | 1 | 1 | 1 | 0 | 0 | 0 | 1 | 1 | 2 |
| D5 | 0 | 0 | 0 | 0 | 0 | 0 | 1 | 1 | 1 | 1 | 1 | 1 |
| D6 | 1 | 1 | 1 | 1 | 1 | 1 | 1 | 1 | 1 | 1 | 1 | 1 |

FIG. 15

| No. | 1 | 2 | 4 | 8 | 16 | 32 | PRIORITY LEVEL |
|---|---|---|---|---|---|---|---|
| 1 | 0 | 0 | 0 | 0 | 0 | 0 | 0 |
| 2 | 1 | 0 | 0 | 0 | 0 | 0 | 1 |
| 3 | 2 | 0 | 0 | 0 | 0 | 0 | 2 |
| 4 | 1 | 1 | 0 | 0 | 0 | 0 | 3 |
| 5 | 2 | 1 | 0 | 0 | 0 | 0 | 4 |
| 6 | 1 | 2 | 0 | 0 | 0 | 0 | 5 |
| 7 | 2 | 0 | 1 | 0 | 0 | 0 | 6 |
| 8 | 1 | 1 | 1 | 0 | 0 | 0 | 7 |
| 9 | 2 | 1 | 1 | 0 | 0 | 0 | 8 |
| 10 | 1 | 2 | 1 | 0 | 0 | 0 | 9 |
| 11 | 0 | 3 | 1 | 0 | 0 | 0 | 10 |
| 12 | 1 | 1 | 2 | 0 | 0 | 0 | 11 |
| 13 | 2 | 1 | 0 | 1 | 0 | 0 | 56 |
| 14 | 0 | 2 | 2 | 0 | 0 | 0 | 12 |
| 15 | 1 | 2 | 0 | 1 | 0 | 0 | 57 |
| 16 | 1 | 0 | 3 | 0 | 0 | 0 | 13 |
| 17 | 0 | 3 | 0 | 1 | 0 | 0 | 58 |
| 18 | 2 | 0 | 1 | 1 | 0 | 0 | 14 |
| 19 | 1 | 1 | 1 | 1 | 0 | 0 | 15 |
| 20 | 0 | 2 | 1 | 1 | 0 | 0 | 16 |
| ... | ... | ... | ... | ... | ... | ... | ... |
| 63 | 0 | 0 | 1 | 0 | 1 | 2 | 50 |
| 64 | 0 | 0 | 0 | 1 | 1 | 2 | 51 |
| 65 | 0 | 0 | 0 | 0 | 2 | 2 | 52 |
| 66 | 0 | 0 | 0 | 1 | 0 | 3 | 53 |
| 67 | 0 | 0 | 0 | 0 | 1 | 3 | 54 |
| 68 | 0 | 0 | 0 | 0 | 0 | 4 | 55 |
| 1 | 0 | 1 | 0 | 0 | 0 | 0 | |
| 2 | 0 | 2 | 0 | 0 | 0 | 0 | |
| 3 | 0 | 0 | 1 | 0 | 0 | 0 | |
| 4 | 1 | 0 | 1 | 0 | 0 | 0 | |
| 5 | 0 | 3 | 0 | 0 | 0 | 0 | |
| 6 | 0 | 1 | 1 | 0 | 0 | 0 | |
| 7 | 0 | 2 | 1 | 0 | 0 | 0 | |
| 8 | 0 | 0 | 2 | 0 | 0 | 0 | |
| 9 | 1 | 0 | 2 | 0 | 0 | 0 | |
| 10 | 1 | 0 | 0 | 1 | 0 | 0 | |
| ... | ... | ... | ... | ... | ... | ... | ... |
| 110 | 0 | 0 | 0 | 0 | 3 | 1 | |
| 111 | 0 | 0 | 0 | 0 | 1 | 2 | |
| 112 | 1 | 0 | 0 | 0 | 1 | 2 | |
| 113 | 0 | 1 | 0 | 0 | 1 | 2 | |
| 114 | 0 | 0 | 0 | 0 | 0 | 3 | |
| 115 | 1 | 0 | 0 | 0 | 0 | 3 | |
| 116 | 0 | 1 | 0 | 0 | 0 | 3 | |
| 117 | 0 | 0 | 1 | 0 | 0 | 3 | |

FIG. 16

| DENSITY LEVEL | D1 | D2 | D3 | D4 | D5 | D6 | DENSITY REFERENCE VALUE |
|---|---|---|---|---|---|---|---|
| 0 | 0 | 0 | 0 | 0 | 0 | 0 | 0.0000 |
| 42 | 1 | 0 | 0 | 0 | 0 | 0 | 0.0159 |
| 84 | 2 | 0 | 0 | 0 | 0 | 0 | 0.0317 |
| | 0 | 1 | 0 | 0 | 0 | 0 | |
| 126 | 1 | 1 | 0 | 0 | 0 | 0 | 0.0476 |
| | 3 | 0 | 0 | 0 | 0 | 0 | |
| 168 | 2 | 1 | 0 | 0 | 0 | 0 | 0.0635 |
| | 4 | 0 | 0 | 0 | 0 | 0 | |
| | 0 | 2 | 0 | 0 | 0 | 0 | |
| | 0 | 0 | 1 | 0 | 0 | 0 | |
| 210 | 1 | 2 | 0 | 0 | 0 | 0 | 0.0794 |
| | 3 | 1 | 0 | 0 | 0 | 0 | |
| | 1 | 0 | 1 | 0 | 0 | 0 | |
| 252 | 2 | 0 | 1 | 0 | 0 | 0 | 0.0952 |
| | 2 | 2 | 0 | 0 | 0 | 0 | |
| | 0 | 3 | 0 | 0 | 0 | 0 | |
| | 0 | 1 | 1 | 0 | 0 | 0 | |
| 294 | 1 | 1 | 1 | 0 | 0 | 0 | 0.1111 |
| | 1 | 3 | 0 | 0 | 0 | 0 | |
| | 3 | 0 | 1 | 0 | 0 | 0 | |
| 335 | 2 | 1 | 1 | 0 | 0 | 0 | 0.1270 |
| | 0 | 4 | 0 | 0 | 0 | 0 | |
| | 0 | 2 | 1 | 0 | 0 | 0 | |
| | 0 | 0 | 2 | 0 | 0 | 0 | |
| 377 | 1 | 2 | 1 | 0 | 0 | 0 | 0.1429 |
| | 1 | 0 | 2 | 0 | 0 | 0 | |
| | 0 | 0 | 0 | 1 | 0 | 0 | |
| 419 | 0 | 3 | 1 | 0 | 0 | 0 | 0.1587 |
| | 2 | 0 | 2 | 0 | 0 | 0 | |
| | 0 | 1 | 2 | 0 | 0 | 0 | |
| | 1 | 0 | 0 | 1 | 0 | 0 | |
| 460 | 1 | 1 | 2 | 0 | 0 | 0 | 0.1746 |
| | 2 | 0 | 0 | 1 | 0 | 0 | |
| | 0 | 1 | 0 | 1 | 0 | 0 | |
| 501 | 0 | 2 | 2 | 0 | 0 | 0 | 0.1905 |
| | 3 | 0 | 0 | 1 | 0 | 0 | |
| | 0 | 0 | 3 | 0 | 0 | 0 | |
| | 1 | 1 | 0 | 1 | 0 | 0 | |
| 543 | 1 | 0 | 3 | 0 | 0 | 0 | 0.2064 |
| | 2 | 1 | 0 | 1 | 0 | 0 | |
| | 0 | 2 | 0 | 1 | 0 | 0 | |
| | 0 | 0 | 1 | 1 | 0 | 0 | |
| 584 | 1 | 2 | 0 | 1 | 0 | 0 | 0.2222 |
| | 0 | 1 | 3 | 0 | 0 | 0 | |
| | 1 | 1 | 1 | 1 | 0 | 0 | |
| ... | ... | ... | ... | ... | ... | ... | ... |
| 2,637 | 0 | 0 | 1 | 0 | 2 | 1 | 1.1270 |
| | 1 | 0 | 1 | 0 | 0 | 2 | |
| 2,825 | 0 | 0 | 0 | 1 | 2 | 1 | 1.2063 |
| | 1 | 0 | 0 | 1 | 0 | 2 | |
| 2,914 | 0 | 0 | 1 | 1 | 0 | 2 | 1.2540 |
| 3,056 | 0 | 0 | 0 | 2 | 0 | 2 | 1.3333 |
| | 0 | 0 | 0 | 0 | 3 | 1 | |
| | 1 | 0 | 0 | 0 | 1 | 2 | |
| 3,138 | 0 | 0 | 1 | 0 | 1 | 2 | 1.3810 |
| 3,271 | 0 | 0 | 0 | 1 | 1 | 2 | 1.4603 |
| 3,470 | 0 | 0 | 0 | 0 | 2 | 2 | 1.5873 |
| | 1 | 0 | 0 | 0 | 0 | 3 | |
| 3,653 | 0 | 0 | 0 | 1 | 0 | 3 | 1.7143 |
| 3,819 | 0 | 0 | 0 | 0 | 1 | 3 | 1.8413 |
| 4,104 | 0 | 0 | 0 | 0 | 0 | 4 | 2.0952 |

FIG. 18

| DENSITY LEVEL | D1 | D2 | D3 | D4 | D5 | D6 | DENSITY REFERENCE VALUE |
|---|---|---|---|---|---|---|---|
| 0 | 0 | 0 | 0 | 0 | 0 | 0 | 0.0000 |
| 56 | 1 | 0 | 0 | 0 | 0 | 0 | 0.0213 |
| 113 | 2 | 0 | 0 | 0 | 0 | 0 | 0.0426 |
| | 0 | 1 | 0 | 0 | 0 | 0 | |
| 169 | 1 | 1 | 0 | 0 | 0 | 0 | 0.0638 |
| 225 | 2 | 1 | 0 | 0 | 0 | 0 | 0.0851 |
| | 0 | 2 | 0 | 0 | 0 | 0 | |
| | 0 | 0 | 1 | 0 | 0 | 0 | |
| 281 | 1 | 2 | 0 | 0 | 0 | 0 | 0.1064 |
| | 1 | 0 | 1 | 0 | 0 | 0 | |
| 337 | 2 | 0 | 1 | 0 | 0 | 0 | 0.1277 |
| | 0 | 3 | 0 | 0 | 0 | 0 | |
| | 0 | 1 | 1 | 0 | 0 | 0 | |
| 393 | 1 | 1 | 1 | 0 | 0 | 0 | 0.1489 |
| 449 | 2 | 1 | 1 | 0 | 0 | 0 | 0.1702 |
| | 0 | 2 | 1 | 0 | 0 | 0 | |
| | 0 | 0 | 2 | 0 | 0 | 0 | |
| 504 | 1 | 2 | 1 | 0 | 0 | 0 | 0.1915 |
| | 1 | 0 | 2 | 0 | 0 | 0 | |
| 559 | 0 | 3 | 1 | 0 | 0 | 0 | 0.2128 |
| | 2 | 0 | 2 | 0 | 0 | 0 | |
| | 0 | 1 | 2 | 0 | 0 | 0 | |
| | 1 | 0 | 0 | 1 | 0 | 0 | |
| ... | ... | ... | ... | ... | ... | ... | ... |
| 2,797 | 1 | 0 | 0 | 1 | 1 | 1 | 1.1915 |
| 2,916 | 0 | 0 | 1 | 1 | 1 | 1 | 1.2553 |
| 3,105 | 0 | 0 | 0 | 2 | 1 | 1 | 1.3617 |
| | 0 | 1 | 0 | 0 | 2 | 1 | |
| | 0 | 2 | 0 | 0 | 0 | 2 | |
| | 0 | 0 | 1 | 0 | 0 | 2 | |
| 3,178 | 0 | 0 | 1 | 0 | 2 | 1 | 1.4043 |
| | 0 | 1 | 1 | 0 | 0 | 2 | |
| 3,352 | 0 | 0 | 0 | 1 | 2 | 1 | 1.5106 |
| | 0 | 1 | 0 | 1 | 0 | 2 | |
| 3,418 | 0 | 0 | 1 | 1 | 0 | 2 | 1.5532 |
| 3,576 | 0 | 0 | 0 | 2 | 0 | 2 | 1.6596 |
| | 0 | 0 | 0 | 0 | 3 | 1 | |
| | 0 | 1 | 0 | 0 | 1 | 2 | |
| 3,636 | 0 | 0 | 1 | 0 | 1 | 2 | 1.7021 |
| 3,778 | 0 | 0 | 0 | 1 | 1 | 2 | 1.8085 |
| 3,957 | 0 | 0 | 0 | 0 | 2 | 2 | 1.9574 |
| | 0 | 1 | 0 | 0 | 0 | 3 | |
| 4,115 | 0 | 0 | 0 | 1 | 0 | 3 | 2.1064 |
| 4,251 | 0 | 0 | 0 | 0 | 1 | 3 | 2.2553 |
| 4,463 | 0 | 0 | 0 | 0 | 0 | 4 | 2.5532 |

c

FIG. 20

| DENSITY LEVEL | D1 | D2 | D3 | D4 | D5 | D6 | DENSITY REFERENCE VALUE |
|---|---|---|---|---|---|---|---|
| 0 | 0 | 0 | 0 | 0 | 0 | 0 | 0.0000 |
| 74 | 1 | 0 | 0 | 0 | 0 | 0 | 0.0278 |
| 147 | 2 | 0 | 0 | 0 | 0 | 0 | 0.0556 |
| 221 | 1 | 1 | 0 | 0 | 0 | 0 | 0.0833 |
| 294 | 2 | 1 | 0 | 0 | 0 | 0 | 0.1111 |
| 367 | 1 | 2 | 0 | 0 | 0 | 0 | 0.1389 |
| 439 | 2 | 0 | 1 | 0 | 0 | 0 | 0.1667 |
| 512 | 1 | 1 | 1 | 0 | 0 | 0 | 0.1944 |
| 584 | 2 | 1 | 1 | 0 | 0 | 0 | 0.2222 |
| 655 | 1 | 2 | 1 | 0 | 0 | 0 | 0.2500 |
| 727 | 0 | 3 | 1 | 0 | 0 | 0 | 0.2778 |
| 798 | 1 | 1 | 2 | 0 | 0 | 0 | 0.3056 |
| 869 | 0 | 2 | 2 | 0 | 0 | 0 | 0.3333 |
| 939 | 1 | 0 | 3 | 0 | 0 | 0 | 0.3611 |
| 1,009 | 2 | 0 | 1 | 1 | 0 | 0 | 0.3889 |
| 1,078 | 1 | 1 | 1 | 1 | 0 | 0 | 0.4167 |
| 1,147 | 0 | 2 | 1 | 1 | 0 | 0 | 0.4444 |
| 1,216 | 1 | 0 | 2 | 1 | 0 | 0 | 0.4722 |
| 1,284 | 0 | 1 | 2 | 1 | 0 | 0 | 0.5000 |
| 1,352 | 2 | 1 | 0 | 0 | 1 | 0 | 0.5278 |
| 1,419 | 1 | 2 | 0 | 0 | 1 | 0 | 0.5556 |
| 1,486 | 2 | 0 | 1 | 0 | 1 | 0 | 0.5833 |
| 1,552 | 1 | 1 | 1 | 0 | 1 | 0 | 0.6111 |
| 1,618 | 0 | 2 | 1 | 0 | 1 | 0 | 0.6389 |
| 1,683 | 1 | 0 | 2 | 0 | 1 | 0 | 0.6667 |
| 1,747 | 2 | 0 | 0 | 1 | 1 | 0 | 0.6944 |
| 1,811 | 1 | 1 | 0 | 1 | 1 | 0 | 0.7222 |
| 1,875 | 0 | 2 | 0 | 1 | 1 | 0 | 0.7500 |
| 1,938 | 1 | 0 | 1 | 1 | 1 | 0 | 0.7778 |
| 2,000 | 0 | 1 | 1 | 1 | 1 | 0 | 0.8056 |
| 2,123 | 0 | 0 | 2 | 1 | 1 | 0 | 0.8611 |
| 2,243 | 0 | 1 | 0 | 2 | 1 | 0 | 0.9167 |
| 2,302 | 2 | 0 | 1 | 0 | 0 | 1 | 0.9444 |
| 2,360 | 0 | 0 | 1 | 2 | 1 | 0 | 0.9722 |
| 2,418 | 0 | 2 | 1 | 0 | 0 | 1 | 1.0000 |
| 2,531 | 2 | 0 | 0 | 1 | 0 | 1 | 1.0556 |
| 2,642 | 0 | 2 | 0 | 1 | 0 | 1 | 1.1111 |
| 2,750 | 0 | 1 | 1 | 1 | 0 | 1 | 1.1667 |
| 2,855 | 0 | 0 | 2 | 1 | 0 | 1 | 1.2222 |
| 2,906 | 2 | 0 | 0 | 0 | 1 | 1 | 1.2500 |
| 3,007 | 0 | 2 | 0 | 0 | 1 | 1 | 1.3056 |
| 3,104 | 0 | 1 | 1 | 0 | 1 | 1 | 1.3611 |
| 3,245 | 1 | 0 | 0 | 1 | 1 | 1 | 1.4444 |
| 3,379 | 0 | 0 | 1 | 1 | 1 | 1 | 1.5278 |
| 3,546 | 0 | 0 | 0 | 2 | 1 | 1 | 1.6389 |
| 3,664 | 0 | 0 | 1 | 0 | 2 | 1 | 1.7222 |
| 3,809 | 0 | 0 | 0 | 1 | 2 | 1 | 1.8333 |
| 3,877 | 0 | 0 | 1 | 1 | 0 | 2 | 1.8889 |
| 4,004 | 0 | 0 | 0 | 2 | 0 | 2 | 2.0000 |
| 4,092 | 0 | 0 | 1 | 0 | 1 | 2 | 2.0833 |
| 4,198 | 0 | 0 | 0 | 1 | 1 | 2 | 2.1944 |
| 4,356 | 0 | 0 | 0 | 0 | 2 | 2 | 2.3889 |
| 4,465 | 0 | 0 | 0 | 1 | 0 | 3 | 2.5556 |
| 4,564 | 0 | 0 | 0 | 0 | 1 | 3 | 2.7500 |
| 4,683 | 0 | 0 | 0 | 0 | 0 | 4 | 3.1111 |

d

INK-JET PRINTING METHOD AND APPARATUS

This application is a division of application Ser. No. 10/339,286 filed Jan. 10, 2003, now U.S. Pat. No. 6,854,822.

FIELD OF THE INVENTION

The present invention relates to an ink-jet printing method and apparatus and, more particularly, to an ink-jet printing method and apparatus which perform multilevel printing by using a plurality of types of inks, which present different densities for similar colors when used for printing, and changing the types of inks and the numbers of ink droplets in printing each pixel.

BACKGROUND OF THE INVENTION

With the widespread use of copying machines, information processing devices such as word processors and computers, and communication devices, apparatuses designed to print images by using ink-jet printing heads have been quickly popularized as printing apparatuses for outputting information from these devices. In addition, with the trend toward higher quality and colorization of visual information in the above information processing devices and communication devices, there have been increasing demands for higher image quality and colorization in printing apparatuses.

In order to meet such demands, printing apparatus are generally designed to have a plurality of printing heads for the respective color inks, i.e., cyan, magenta, yellow, and black inks, so as to cope with the trend toward colorization. To cope with the tendency toward smaller printing pixels and the like, each printing head has a printing element array formed by integrating/arraying a plurality of printing elements and pluralities of orifices and channels which are integrated at high densities.

There is, however, a certain limitation in integrating orifices and channels at high densities, and hence there is a certain limitation in reducing the size of pixels to be printed. In an image printed by such a printing apparatus, since dots forming each pixel become relatively large, an image highlight portion with a low density or the like gives a sense of graininess, posing a problem in terms of image quality.

In contrast to this, a so-called multidrop scheme is known, which reduces the liquid amount of ink droplet discharged and forms one pixel by the number of ink droplets corresponding to a printing density instead of increasing the integration densities of the ink orifices and channels, i.e., reducing the size of one pixel. According to the multidrop scheme, since the diameter of an ink dot printed on a printing sheet can be made relatively small, the sense of graininess at a low-density portion such as a highlight portion can be improved.

However, as the liquid amount of ink droplet decreases, discharging operation becomes unstable. For this reason, there is a certain limitation in reducing the ink dot size, and hence a certain limitation is imposed on the improvement of image quality. In addition, according to this scheme, as the printing gray level increases, the number of ink droplets to be discharged per pixel increases, resulting in a decrease in printing speed. This produces a contradictory relationship that as the image quality improves, the printing speed decreases.

As another method of improving image quality without increasing the orifice integration density, a halftone printing scheme using two types of inks, i.e., dense and light inks having different ink densities, is known. According to this scheme, a highlight portion is printed with light ink having a low density to make the sense of graininess due to ink dots less conspicuous, and a high-density portion is printed with dense ink. For this reason, a high-density portion can be formed without increasing the number of ink droplets unlike in the multidrop scheme, and an increase in ink droplet amount used for printing and a decrease in printing speed can be suppressed.

As pseudo-halftone processing methods using binarization processing or multilevel conversion processing, a dither method, error diffusion method, average density reserve method, and the like are known.

In the dither method, each pixel data is binarized with a threshold for each pixel determined by a dither matrix.

In the error diffusion method, for example, as described in R. Floyd & L. Steinberg, "An Adaptive Algorithm for Spatial Gray Scale", SID 75 DIGEST, pp. 36–37, the multilevel image data of a target pixel is binarized (converted into densest-level or lightest-level data), and the difference (error) between the binarized data and the data before binarization is distributed and added to neighboring pixels.

In the average density reserve method, as disclosed in, for example, Japanese Patent Laid-Open No. 2-210962, a threshold is obtained on the basis of binary data obtained by binarizing a pixel near a target pixel or data containing data obtained by binarizing the target pixel into black or white data, and the image data of the target pixel is binarized with this threshold.

In addition, multilevel conversion processing can be done by slightly changing or correcting these binarization methods.

In these methods, however, problems arise depending on the type of image to be printed.

When, for example, a transmission image or the like which requires high grayscale quality even though it is monochrome, e.g., a chest X-ray image, in particular, the human vision resolution with respect to density increases because of the transmission image. As a consequence, even when dense and light inks are used, the density differences among the respective pixels are recognized, giving an impression of a coarse image. That is, it is required to increase the number of printing gray levels.

In the above method, in order to increase the number of gray levels for each pixel, the number of dense and light inks must be increased, and hence many multiheads are required. That is, a great increase in cost is inevitable.

As disclosed in Japanese Patent Laid-Open No. 10-324002, the present inventors therefore have proposed a grayscale printing method in which a plurality of types of inks with different densities are designed to be discharged for one color, and an ink droplet is selectively discharged a plural number of times (superimposition) for one pixel within a predetermined limit, thereby increasing the number of gray levels expressed by this pixel. According to this method, many gray levels can be expressed without greatly increasing the number of dense and light inks and the number of multiheads.

In the above grayscale printing method, however, the following problems are posed.

For example, ink stored in an apparatus for a long period of time undergoes a change in density in the path of an ink supply system owing to the influences of evaporation of water. In order to prevent this, the ink supply system may be entirely made of a material that shuts off vapor. This measure, however, demands a high cost, and hence the apparatus increases in cost.

Alternatively, a change in ink density in the ink supply system may be measured to manage the ink. According to this method, however, an ink density needs to be measured with a certain or higher precision, and hence a device for measurement is required, resulting in too much cost.

In addition, even if inks having the same density are used, a slight printing density difference is produced or printing cannot be done with an intended density (gray level) owing to a difference in characteristic (discharge amount) between printing heads. Consider a case wherein a printing head B is larger in discharge amount than a printing head A by about 5%. When ink with a dye concentration of 0.2% is discharged from the printing head A, and ink with a dye concentration of 4% is discharged from the printing head B, the density ratio of the inks themselves is 1:20, but the dye ratio on a printing medium, i.e., the density ratio, becomes about 1:21. In the above grayscale printing method, therefore, a portion with a low gray level may become higher in printing density than a portion with a high gray level (gray-level reversal).

In order to prevent such gray-level reversal, it is preferable that the actual printing densities obtained by combinations of dense and light inks used be measured, and combinations of inks to be used for the respective gray levels be determined in accordance with the measurement result. This method, however, takes much time and labor, and is not practicable.

In addition, in a printer in a ready state, ink increases in density over time as water evaporates. For this reason, even when identical images are printed, some of them may become higher in density than the remaining ones. It is very difficult to measure ink densities as absolute densities such as optical densities and maintain or manage them. Therefore, such a method has not been put into practice. Consequently, it is very difficult to predict the density of a printed image in terms of an absolute value.

SUMMARY OF THE INVENTION

It is the first object of the present invention to print a good grayscale image free from gray-level reversal and the like.

It is the second object of the present invention to always print a good grayscale image at an intended density regardless of the state of ink.

In order to achieve the first object, according to the first aspect of the present invention, there is provided an ink-jet printing apparatus which performs multilevel printing by using a plurality of types of inks which present different densities for similar colors, when used for printing, and changing the types of inks and the numbers of ink droplets in printing each pixel, comprising: input means for inputting information associated with relative densities for the respective inks in case of being used for printing; table generating means for generating, on the basis of the information associated with the relative densities, an ink distribution table for defining a combination of the types of inks and the numbers of ink droplets in correspondence with each gray level value; and combination selection means for selecting, on the basis of the ink distribution table, the combination to be used to print each pixel.

In order to achieve the first object, according to the first aspect of the present invention, there is provided an ink-jet printing method which performs multilevel printing by using a plurality of types of inks, which present different densities for similar colors when used for printing, and changing the types of inks and the numbers of ink droplets in printing each pixel, comprising: the input step of inputting information associated with relative densities for the respective inks in case of being used for printing; the table generating step of generating, on the basis of the information associated with the relative densities, an ink distribution table for defining a combination of the types of inks and the numbers of ink droplets in correspondence with each gray level value; and the combination selection step of selecting the combination to be used to print each pixel on the basis of the ink distribution table.

According to the first aspect of the present invention, when multilevel printing is performed by using a plurality of types of inks, which present different densities for similar colors when used for printing, and changing the types of inks and the numbers of ink droplets in printing each pixel, an ink distribution table which defines a combination of the types of inks and the numbers of ink droplets in correspondence with each gray level value is generated on the basis of input information associated with the relative densities of the respective inks. A combination to be used to print each pixel is selected on the basis of the ink distribution table.

According to this operation, an ink distribution table for defining a combination of the types of inks and the numbers of ink droplets in correspondence with each gray level value is generated on the basis of input information associated with the relative densities of the respective inks instead of the dye concentrations of the inks.

Since a proper combination of the types of inks and the numbers of ink droplets can be obtained in accordance with each gray level as a gray level by inputting information associated with the relative densities of the respective inks on the basis of actual printing densities, a good grayscale image free from gray-level reversal and the like can be printed.

Preferably, the ink distribution table is generated by using an initial table in which a predetermined number of combinations are defined, and a combination to be preferentially selected is designated.

The information associated with the relative densities of the respective inks may be expressed by a ratio with a density of ink having a lowest density being regarded as 1.

In this case, the ink distribution table may be generated by calculating the sum of the ratios with respect to ink droplets contained in each combination, and by obtaining a gray level value corresponding to the sum of the ratios.

Preferably, the ink distribution table defines one combination of the types of inks and the numbers of ink droplets with respect to each gray level value, or a plurality of combinations of the types of inks and the numbers of ink droplets for some gray level values.

In order to achieve the second object, according to the second aspect of the present invention, there is provided an ink-jet printing apparatus which performs multilevel printing by using a plurality of types of inks, which present different densities for similar colors when used for printing, and changing the types of inks and the numbers of ink droplets in printing each pixel, comprising: input means for inputting information associated with relative densities for the respective inks in case of being used for printing; reference combination input means for inputting a combination of the types of inks and the numbers of ink droplets which exhibits a predetermined density as a reference combination; table generating means for generating, on the basis of information associated with the relative densities and the reference combination, an ink distribution table which defines a correspondence between various combinations of the types of inks and the numbers of ink droplets and gray level values printed by the respective combinations; and combination selection means for selecting, on the basis of the ink distribution table, a combination of the types of inks and the numbers of ink droplets to be used to print each pixel.

In order to achieve the second object, according to the second aspect of the present invention, there is provided an ink-jet printing method which performs multilevel printing by using a plurality of types of inks, which present different densities for similar colors when used for printing, and changing the types of inks and the numbers of ink droplets in printing each pixel, comprising: the input step of inputting information associated with relative densities for the respective inks in case of being used for printing; the reference combination input step of inputting a combination of the types of inks and the numbers of ink droplets which exhibits a predetermined density as a reference combination; the table generating step of generating, on the basis of information associated with the relative densities and the reference combination, an ink distribution table which defines a correspondence between various combinations of the types of inks and the numbers of ink droplets and gray level values printed by the respective combinations; and the combination selection step of selecting, on the basis of the ink distribution table, a combination of the types of inks and the numbers of ink droplets to be used to print each pixel.

According to the present invention, when multilevel printing is performed by using a plurality of types of inks, which present different densities for similar colors when used for printing, and changing the types of inks and the numbers of ink droplets in printing each pixel, information associated with the relative densities of the respective inks is input, and a combination of the types of inks and the numbers of ink droplets which exhibits a predetermined density is input as a reference combination. An ink distribution table for defining the correspondence between various combinations of the types of inks and the numbers of ink droplets and the gray level values printed with the respective combinations is generated on the basis of the information associated with the relative densities and the reference combination. A combination of the types of inks and the numbers of ink droplets to be used to print each pixel is selected on the basis of this ink distribution table.

Even if the densities of inks change due to the influences of evaporation of water and the like, an ink distribution table for defining the correspondence between a combination of the types of inks and the numbers of ink droplets and the gray level value printed with each combination is generated on the basis of the reference combination exhibiting the predetermined density and the information associated with the relative densities of the respective inks to be used.

Even if, therefore, the densities of inks change, since the correspondence between each gray level value and each ink combination is defined with reference to an ink combination which exhibits the predetermined density at this time, a good grayscale image can always be printed at an intended density.

The information associated with the relative densities of the respective inks may be expressed by a relative density ratio with a density of ink having a lowest density being regarded as 1.

In this case, the table is generated by calculating a density reference value for expressing the sum of the ratios with respect to ink droplets contained in each combination as a density reference value with respect to the sum of the ratios with respect to ink droplets contained in the reference combination, and by converting the density reference value into the gray level value.

Preferably, a test pattern is generated by printing a predetermined pattern with various combinations of the types of inks and the numbers of ink droplets on a printing medium having a portion which is printed in advance at the predetermined density.

The predetermined density may fall within a range of 0.5 to 2.0 in terms of optical density (O.D.).

The ink distribution table may be generated by using an initial table in which a predetermined number of combinations are defined, and a combination to be preferentially selected is designated.

The ink distribution table may define one combination of the types of inks and the numbers of ink droplets with respect to each gray level value, or a plurality of combinations of the types of inks and the numbers of ink droplets for some gray level values.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the descriptions, serve to explain the principle of the invention.

FIG. 3 is a view showing ink combinations used to print the pattern in FIG. 2;

FIG. 4 is a view showing an initial table in this embodiment;

FIG. 6 is a view showing an ink distribution table in this embodiment;

FIG. 13 is a view showing ink combinations used to print the set density detection pattern in FIG. 12;

FIG. 15 is a view showing an initial table in the second embodiment;

FIG. 16 is a view showing an ink distribution table in the second embodiment;

FIG. 18 is a view showing an ink distribution table in the third embodiment;

FIG. 20 is a view showing an ink distribution table in the fourth embodiment;

DETAILED DESCRIPTION OF THE PREFERRED EMBODIMENTS

Figure 1:
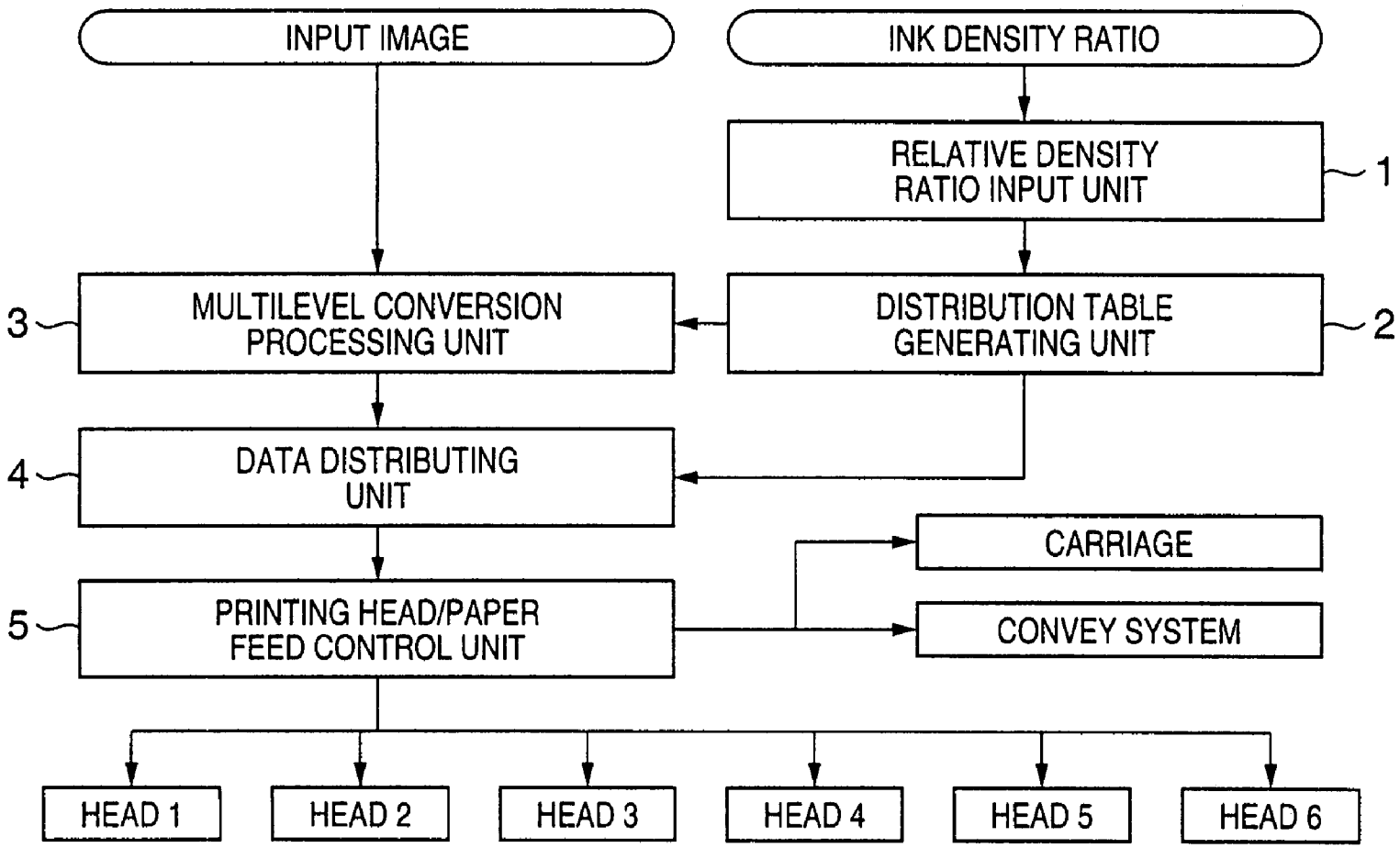
FIG. 1 is a functional block diagram showing an outline of processing in an embodiment according to the first aspect of the present invention.

Preferred embodiments of the present invention will now be described in detail in accordance with the accompanying drawings.

In this specification, "print" means not only to form significant information such as characters and graphics, but also to form, e.g., images, figures, and patterns on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

[Basic Principle of First Aspect of Present Invention]

The basic principle of the first aspect of the present invention will be described first.

In the present invention, when multilevel printing is to be performed by using a plurality of types of inks which present different densities for similar colors when used for printing and changing the types of inks and the numbers of ink droplets which are used to print each pixel, the relative density ratios between the respective inks are obtained, an ink distribution table for designating a combination of the types of inks and the numbers of ink droplets to be used in accordance with each gray level value is generated on the basis of the density ratios. When an image is printed by multilevel conversion processing using this ink distribution table, a good grayscale image is obtained.

As ink distribution tables, the following tables are conceivable: a table having only one combination of the types of inks and the numbers of ink droplets to be used in correspondence with each gray level value; and a table having two or more such combinations. An ink distribution table may be generated by a method of generating an entire table on the basis of input relative density ratios or a method of correcting and changing a prepared table. The present invention uses the method of correcting and changing a prepared table to shorten the time required to generate a table.

The sum of relative density ratios for each combination of the types of inks and the numbers of ink droplets in the prepared ink distribution table is calculated by using input ink relative density ratios, and predetermined conversion of the sum is performed to calculate a gray level value. This conversion is done by using an appropriate function and table to obtain a gray level value (density level) from the relationship between the sum of relative density ratios for a combination to be used and the printing density. Such conversion function and table are properly selected in accordance with the type of printing medium to be used for printing and the like.

Assume that a table having only one combination of the types of inks and the numbers of ink droplets to be used in accordance with each gray level value is to be used. In this case, if there are a plurality of combinations exhibiting the same sum of relative density ratios, for example, a combination designated in advance in accordance with priority or the like is used while the remaining combinations are removed from the ink distribution table and are not used.

Assume that a table having two or more combinations of the types of inks to be used and the numbers of ink droplets in accordance with each gray level value is used. In this case, if there are a plurality of combinations exhibiting the same sum of relative density ratios, combinations exhibiting the same sum of relative density ratios are written along the combination designated in advance.

In this case, when printing is performed by using the ink distribution table, for example, the following method is used: (1) a method of using the plurality of ink combinations repeatedly or randomly; and (2) a method of mainly using one ink combination while using the remaining combinations at times as needed. However, the present invention is not limited to any specific method. In method (2), it is preferable that the combination designated in advance be mainly used.

In the present invention, it is necessary to input ink relative density ratios. Such ink relative density ratios are determined by printing images by using inks having various densities and obtaining combinations exhibiting almost the same printing density. If, for example, four ink droplets with a dye concentration of 1% and one ink droplet with a dye concentration of 4% exhibit almost the same printing density, it is determined that the ink relative density ratio is 1:4. The printing density may be optical reflection density or optical transmission density of a printed portion on a medium, and one of the evaluation standards should be selected as the need arises.

In practice, if the numbers of ink droplets (ink discharge count) used to print one pixel differ, the resultant printing densities may differ. It is therefore preferable that printing densities be compared with each other after the ink discharge count is set. Note that this density comparison is performed by printing some test patterns. The comparison may be done by visual check or densitometer. That is, the comparison method is not specifically limited.

In addition, in the present invention, a criterion for determining a combination of the types of inks and the numbers of ink droplets to be used which is designated in advance to be preferentially used is not specifically limited. It is, however, preferable that a criterion be determined in consideration of density stability, resistance to the influences of "kink" and the like due to the discharge characteristics of each nozzle of a printing head, and the like.

First Embodiment

A preferred embodiment of the present invention will be described in detail below with reference to the accompanying drawings.

The embodiment to be described below will exemplify an ink-jet printer which prints a chest X-ray medical image (12 bits: 4096 gray levels) on a transmission type film by using a plurality of types of inks for blackish colors.

<Brief Description of a Printing Apparatus>

Figure 9:
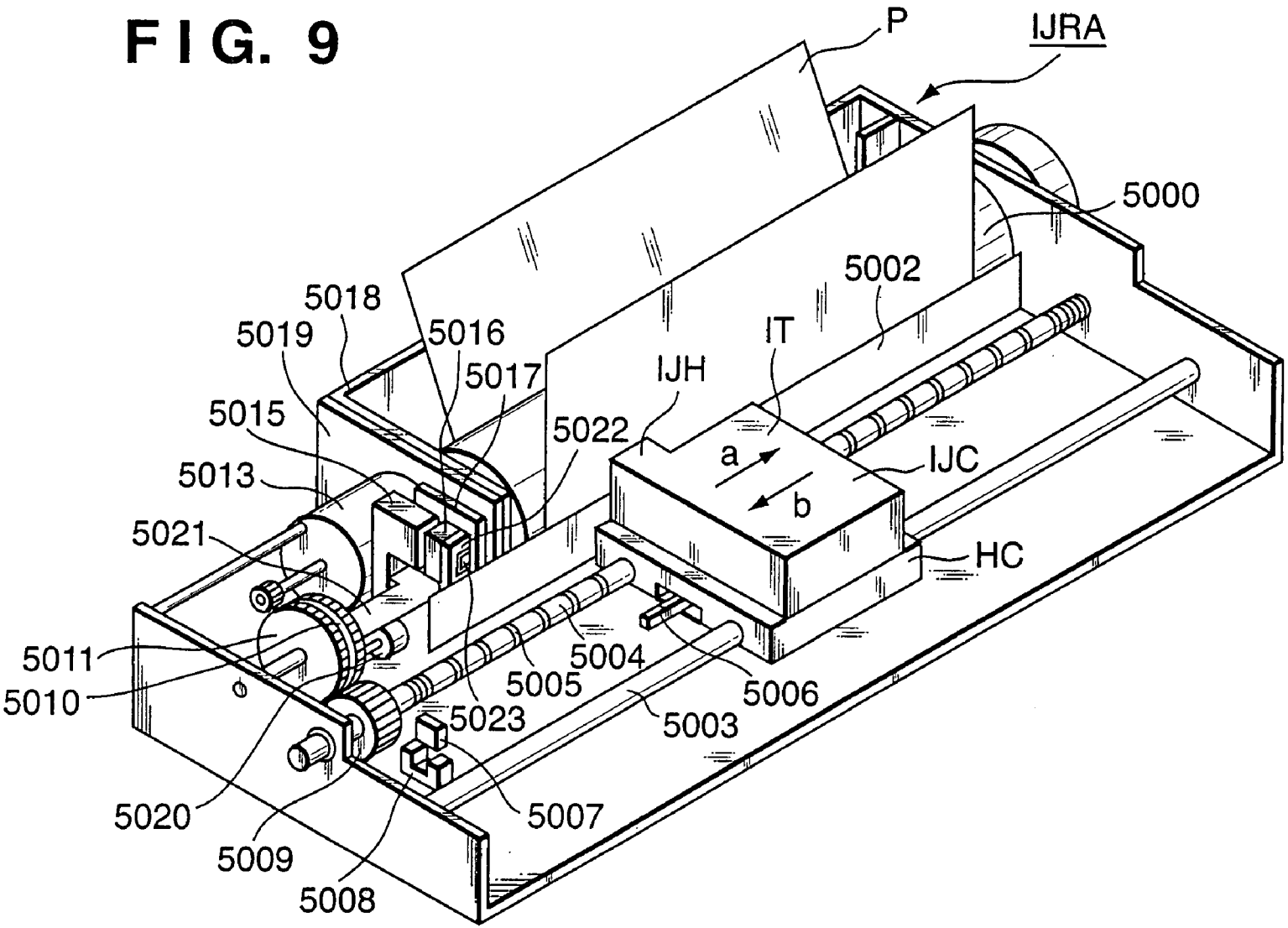
FIG. 9 is a perspective view showing an outer appearance of the construction of a printing apparatus according to the present invention.

FIG. 9 is a perspective view showing the outer appearance of an ink-jet printer IJRA as a typical embodiment of the present invention. Referring to FIG. 9, a carriage HC engages with a spiral groove 5005 of a lead screw 5004, which rotates via driving force transmission gears 5009 to 5011 upon forward/reverse rotation of a drive motor 5013. The carriage HC has a pin (not shown), and is reciprocally moved in directions of arrows a and b in FIG. 1. An integrated ink-jet cartridge IJC, which incorporates a printing head IJH and an ink tank IT, is mounted on the carriage HC.

Reference numeral 5002 denotes a sheet pressing plate, which presses a paper sheet against a platen 5000, ranging from one end to the other end of the scanning path of the carriage. Reference numerals 5007 and 5008 denote photocouplers which serve as a home position detector for recognizing the presence of a lever 5006 of the carriage in a corresponding region, and used for switching, e.g., the rotating direction of motor 5013.

Reference numeral 5016 denotes a member for supporting a cap member 5022, which caps the front surface of the printing head IJH; and 5015, a suction device for sucking ink residue through the interior of the cap member. The suction device 5015 performs suction recovery of the printing head via an opening 5023 of the cap member 5015. Reference numeral 5017 denotes a cleaning blade; 5019, a member which allows the blade to be movable in the back-and-forth direction of the blade. These members are supported on a main unit support plate 5018. The shape of the blade is not limited to this, but a known cleaning blade can be used in this embodiment.

Reference numeral 5021 denotes a lever for initiating a suction operation in the suction recovery operation. The lever 5021 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5004 when the carriage reaches the home-position side region. However, the present invention is not limited to this arrangement as long as desired operations are performed at known timings.

<Description of a Control Arrangement>

Next, the control structure for performing the printing control of the above apparatus is described.

Figure 10:
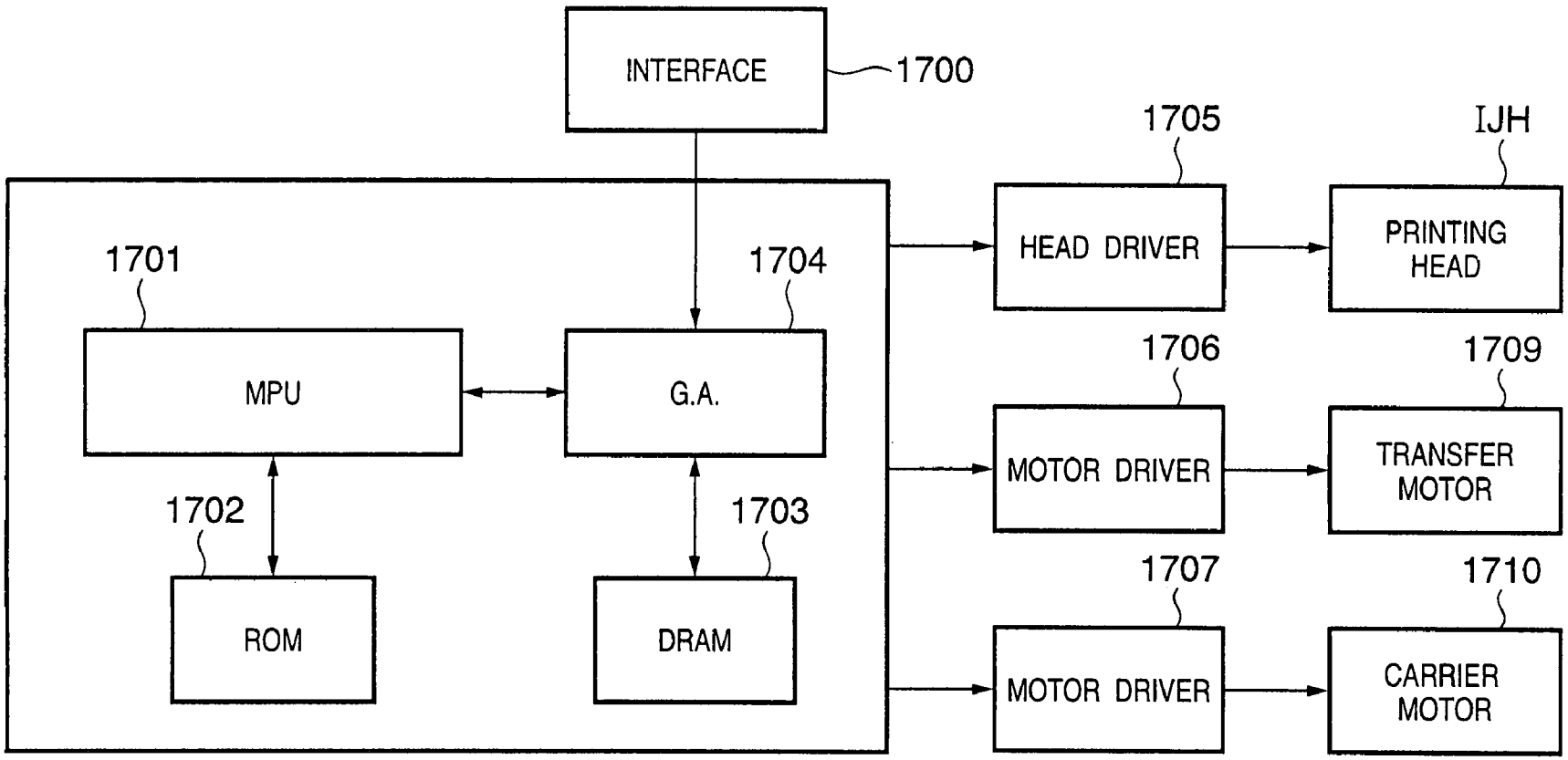
FIG. 10 is a block diagram showing an arrangement of a control circuit of the printing apparatus shown in FIG. 9.

FIG. 10 is a block diagram showing the arrangement of a control circuit of the ink-jet printer. Referring to FIG. 10 showing the control circuit, reference numeral 1700 denotes an interface for inputting a print signal from an external unit such as a host computer; 1701, an MPU; 1702, a ROM for storing a control program (including character fonts if necessary) executed by the MPU 1701; and 1703, a DRAM for storing various data (the print signal, print data supplied to the printing head and the like). Reference numeral 1704 denotes a gate array (G.A.) for performing supply control of print data to the printing head IJH. The gate array 1704 also performs data transfer control among the interface 1700, the MPU 1701, and the RAM 1703. Reference numeral 1710 denotes a carrier motor for transferring the printing head IJH in the main scanning direction; and 1709, a transfer motor for transferring a paper sheet. Reference numeral 1705 denotes a head driver for driving the printing head; and 1706 and 1707, motor drivers for driving the transfer motor 1709 and the carrier motor 1710.

The operation of the above control arrangement will be described below. When a print signal is inputted into the interface 1700, the print signal is converted into print data for a printing operation between the gate array 1704 and the MPU 1701. The motor drivers 1706 and 1707 are driven, and the printing head is driven in accordance with the print data supplied to the head driver 1705, thus performing the printing operation.

Though the control program executed by the MPU 1701 is stored in the ROM 1702, an arrangement can be adopted in which a writable storage medium such as an EEPROM is additionally provided so that the control program can be altered from a host computer connected to the ink-jet printer IJRA.

Note that the ink tank IT and the printing head IJH are integrally formed to construct an exchangeable ink cartridge IJC, however, the ink tank IT and the printing head IJH may be separately formed such that when ink is exhausted, only the ink tank IT can be exchanged for new ink tank.

<Ink, Printing Medium, and the Like>

In this embodiment, six types of inks D1 to D6 as indicated by Table 1 are used, which contain water as a main component and dyes at relative density ratios of 1:2:4:8:16:32. In addition, in order to improve discharge stability, these inks contain an additive such as glycerin or urea at a weight ratio of 0.1 to 10%.

TABLE 1

| | Type of Ink | | | | | |
|---|---|---|---|---|---|---|
| | D1 | D2 | D3 | D4 | D5 | D6 |
| Dye Content | 0.15 | 0.3 | 0.6 | 1.2 | 2.4 | 4.8 |
| Density Ratio | 1 | 2 | 4 | 8 | 16 | 32 |

The printing medium used in this embodiment is a transparent film having an ink-receiving layer (Canon CF-301), and the printing head has a nozzle density of 600 dpi and a discharge amount of 8.5 pl.

Note that in this arrangement, the ink discharge count per pixel was limited to about 4 to 5.

This embodiment used a printing method using a distribution table containing a plurality of ink combinations for one gray level value.

<Outline of Processing>

FIG. 1 is a functional block diagram showing an outline of processing in this embodiment. Reference numeral 1 denotes a relative density ratio input unit; 2, a distribution table generating unit; 3, a multilevel conversion processing unit; 4, a data distributing unit; and 5, a printing head/paper feed control unit.

<Inputting of Relative Density Ratios>

The relative density ratio input unit 1 outputs ink relative density ratios to the distribution table generating unit 2. Ink relative density ratios may be determined, as needed, for example, after a printing head is replaced or a predetermined period of time elapses, or when the user feels that grayscale quality has deteriorated or the printing head has not been used for a long period of time. This determination need not always be performed before the image printing operation.

The relative density ratio input unit 1 has an ink relative density ratio memory for storing/holding ink relative density ratio data that has been determined most recently. When new ink relative density ratios are determined, the contents of the memory are updated. When no new ink relative density ratios are determined, the values held in the memory are output to the distribution table generating unit 2.

<Density Determination Pattern>

Figure 2:
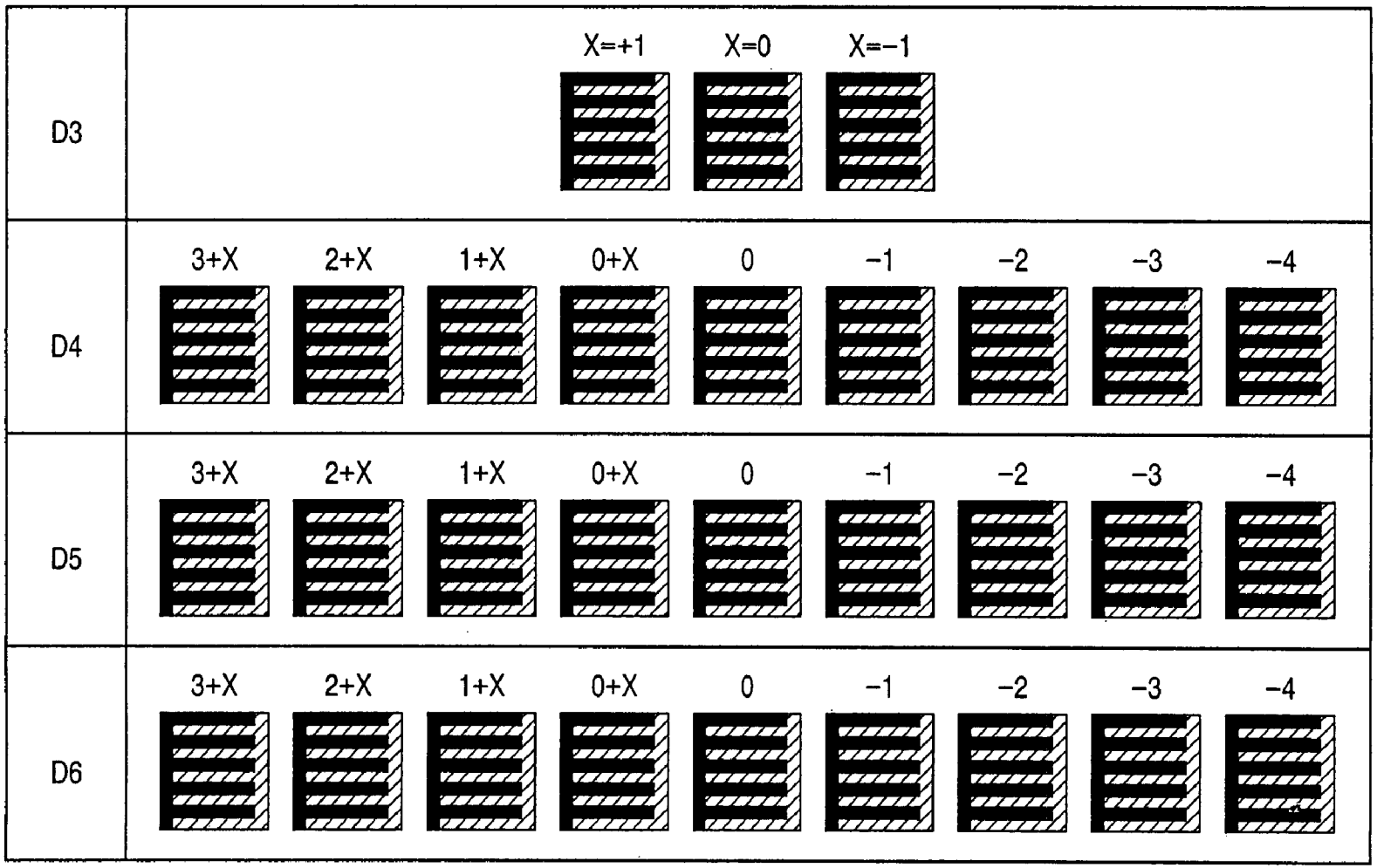
FIG. 2 is a view showing a test pattern for determining relative density ratios.

FIG. 2 shows an example of the density determination pattern which is printed to determine ink relative density ratios in this embodiment. Each portion of this density determination pattern has two comblike areas which are combined together. In this embodiment, such a pattern is printed, and a portion in which the densities of the two areas are almost equal to each other is selected by visual check, thereby obtaining the relative density of each ink.

FIG. 3 is a view showing the combinations of inks used to print the density determination pattern. The numeral in each cell in FIG. 3 indicates the number of ink droplets discharged. In this embodiment, each portion is printed by four ink droplets.

FIG. 3 shows a density determination pattern for inks D3 to D6, and each of the numerals written on the respective rows indicates a value by which the relative density ratio of a target ink increases/decreases as compared with the corresponding dye concentration ratio shown in Table 1 when it is determined that the densities of the two areas are almost equal to each other. If, for example, it is determined with respect to ink D3 that the densities of the two areas of the portion with "0" are almost equal to each other, the relative density ratio of ink D3 is "4", which is equal to the dye concentration. If it is determined with respect to ink D4 that the densities of the two areas of the portion with "1+X" are almost equal to each other, the relative density ratio of ink D4 is dye concentration ratio+1, i.e., "9".

The relative density ratios of the respective inks obtained in the above manner were D1:D2:D3: D4:D5:D6=1:2:4:9:17:33. These values were input to the relative density ratio input unit 1.

<Generation of Distribution Table>

The distribution table generating unit 2 has an initial table memory in which some prepared combinations of the types of inks and the numbers of ink droplets are stored/held, together with their priority levels, and generates an ink distribution table by correcting/changing the table.

FIG. 4 is a view showing an example of the contents of the initial table memory in this embodiment. The portion indicated by "a" in FIG. 4 is the initial table. In this initial table, a total of 185 ink combinations are written, i.e., 56 ink combinations for which priority levels are set, and the 129 remaining ink combinations. Note that in the priority level cells in FIG. 4, smaller numerals indicate higher priority levels, and the blank cells indicate the remaining combinations.

The sum of relative density ratios is calculated for each combination. The calculated sums of relative density ratios are written in the sum (b) cells in FIG. 4. The combinations written in the initial table are sorted according to the sums. If some combinations exhibit the same sum, one that has a higher priority level (one with a smaller numeral in the priority level cell in FIG. 4) is written first so as to be mainly used. In addition, the other combination exhibiting the lower priority level and one of the remaining combinations which exhibits the same sum of density ratios are written following the combinations which are mainly used.

Equations (1) and (2) given below are used to obtain a gray level value (density level) from the sum of relative density ratios. Equation (1) represents the relationship between the amount of dye (the sum of the relative density ratios of ink discharged) on a printing medium. Equations (2) are used to linearly convert an optical density into 12-bit data (0: white; 4095: black).

$$O.D.=a_0+a_1d+a_2d^2+a_3d^3a_4d^4 \quad (1)$$

where d: sum of density ratios (density of D6=1), and $a_0$ to $a_4$: coefficients.

$a_0=0.05$, $a_1=0.901$, $a_2=-1.2353\times10^{-1}$, $a_3=3.3643\times10^{-2}$, $a_4=-5.2442\times10^{-3}$ $$\text{Level}=4095\{O.D.(d)-O.D.(d_0)\}/\{O.D.(d_{max}-O.D.(d_0)\} \quad (2)$$

where $d_0$: sum of relative density ratios, and $d_{max}$: sum of relative density ratios=maximum value.

Figure 5:
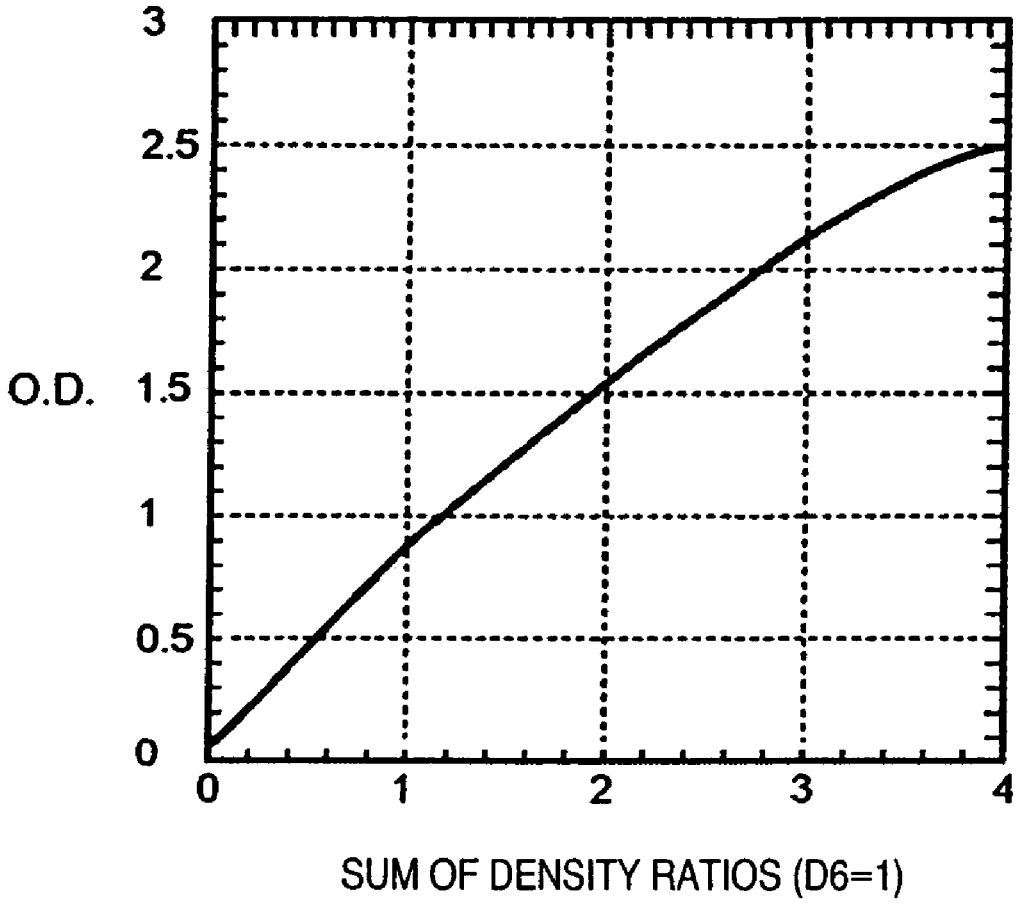
FIG. 5 is a graph showing the relationship between the dye amount on a recording medium and the optical density.

FIG. 5 is a graph showing the relationship represented by equation (1).

In this manner, an ink distribution table is generated. FIG. 6 shows an example of the ink distribution table generated in this embodiment. Referring to FIG. 6, the combinations for which gray level values (density levels) are written are combinations that are mainly used, and each combination with a blank density level cell indicates that it has the same density level as that of the preceding combination. Note that the total number of density levels was 53.

When a distribution table having only one ink combination for each gray level value is to be used, only 56 ink combinations for which priority levels are set are stored/held in the initial table memory in the distribution table generating unit 2. In addition, if some combinations exhibit the same sum of relative density ratios, one exhibiting a lower priority level is deleted, and a density level is obtained by the remaining combinations, thereby generating an ink distribution table.

<Print Data Generation Processing>

The density levels in the ink distribution table obtained in the above manner are supplied to the multilevel conversion processing unit 3, and multilevel conversion processing of an input image is performed. Note that in this case, base-53 conversion processing was performed by using a general error diffusion method.

The data distributing unit 4 generates discharge data for each ink by using the data having undergone multilevel conversion processing and the distribution table.

A method of distributing ink for each pixel according to this embodiment will be described below. The data having undergone multilevel conversion processing is counted for each density level by a counter provided for each density level. If, for example, the data having undergone multilevel conversion processing is "440", a counter for density level 440 becomes $N_{440}$+=1.

As ink combinations (D1, . . . , D6) exhibiting density level "440", four kinds of ink combinations (0,3,1,0,0,0), (1,0,0,1,0,0), (0,1,2,0,0,0), and (2,0,2,0,0,0) are provided by the ink distribution table. Therefore, the number of kinds of ink combinations exhibiting density level "440" is $K_{440}=4$. A determination is made by using these data in accordance with condition (3) given below, and whether mth combination of $K_{440}=4$ types of ink combinations is used is determined.

if ($N_{440}$%4)
m=0;
else $$m=(N_{440}/4)\ \%\ (K_{440}-1)+1; \quad (3)$$

In (3), "%" is an operational sign indicating the remainder.

As a consequence, about 75% become m=0, and the main combination for this pixel, i.e., (0,3,1,0,0,0) in this case, is used. If m=1, the combination (1,0,0,1,0,0) is used. After an ink combination to be used for one pixel is determined in this manner, data are distributed for the respective inks in accordance with the combination.

The data distributed for the respective inks in the above manner are made to correspond to the nozzles of the printing head by the printing head/paper feed control unit 5, and are printed by driving the printing head in synchronism with the transfer system.

The image printed by the ink-jet printer according to this embodiment was free from gray-level reversal and the like and almost equal in quality to the image printed by a general medical laser imager.

Figure 7:
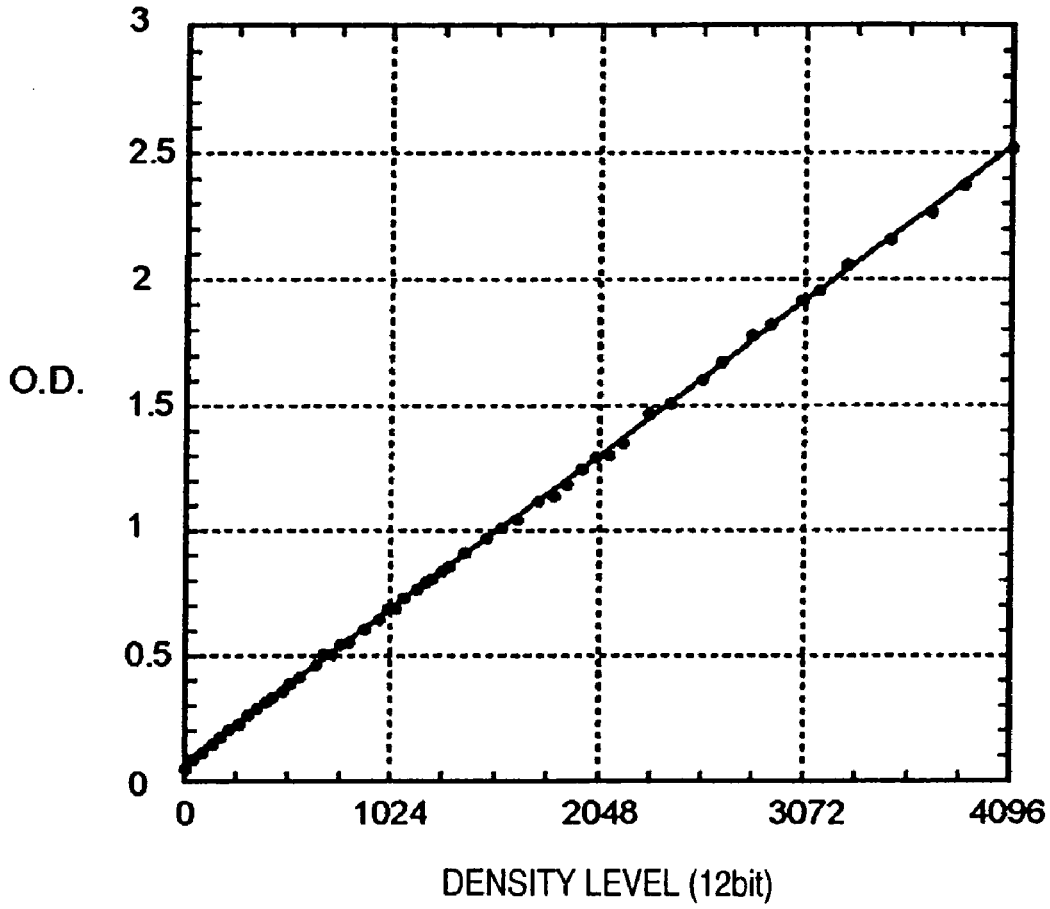
FIG. 7 is a graph showing the relationship between the gray level value and the optical density in this embodiment.

In addition, in order to evaluate the result in this embodiment, patches each having a size of 200×200 pixels (about 8.5 $mm^2$) were printed in correspondence with 53 levels, i.e., the number of multilevel values, and the respective densities were measured. FIG. 7 is a graph showing the result. As is obvious from this result as well, no density reversal occurred among the respective levels. In addition, when the relationship between the density level and the optical density was approximated by a straight line, R=0.99989, an excellent correlation coefficient, was obtained.

Comperative Example of First Embodiment

No ink relative density ratio determining operation in the above embodiment was performed, and the dye concentration ratios of inks, i.e., 1:2:4:8:16:32, were used as ink relative density ratios without any change.

Figure 8:
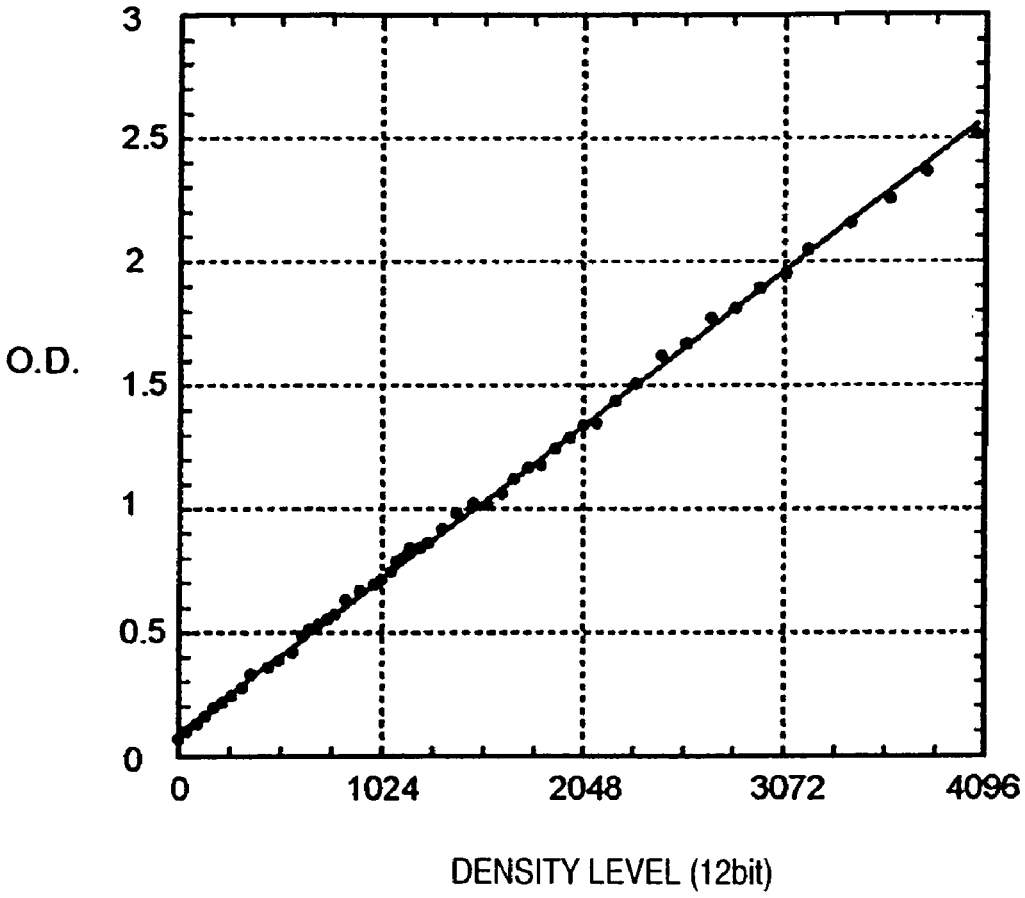
FIG. 8 is a graph showing the relationship between the gray level value and the optical-density in a comparative example.

A combination table using six types of inks was generated on the basis of these values. Patches were then accurately printed in correspondence with 56 levels as in the above embodiment, and the respective densities were measured. FIG. 8 is a graph showing the result. As is indicated by this graph as well, for example, density reversal occurred at several portions near density levels 800 and 1500.

In this example, no desired image was obtained, and the correlation coefficient obtained when the relationship between the density level and the optical density was approximated by a straight line was R=0.99948, which was inferior to that value in the above embodiment.

[Basic Principle of Second Aspect of Present Invention]

The basic principle of the second aspect of the present invention will now be described.

In the present invention, when multilevel printing is to be performed by using a plurality of types of inks with different densities on a printing medium for similar colors and changing the types of inks and the numbers of ink droplets which are used to print each pixel, an ink distribution table for designating a combination of the types of inks and the numbers of ink droplets to be used in accordance with each gray level value is generated by obtaining the relative density ratios of the respective inks and an ink combination exhibiting a predetermined density, and converting the sum of the relative density ratios of each ink combination with reference to the sum of the relative density ratios of the ink combination exhibiting the predetermined density. When an image is printed after multilevel conversion processing is performed by using this ink distribution table, a good grayscale image can be obtained.

More specifically, the sum of the relative density ratios of an ink combination exhibiting a predetermined density is calculated by using input ink relative density ratios, and the sum of the relative density ratios of each ink combination is converted into a numerical value representing a ratio to the sum of the relative densities of the ink combination exhibiting the predetermined density. A gray level value is then calculated from this converted value by arbitrary conversion. An ink combination exhibiting the predetermined density is obtained by printing several patterns and comparing each pattern with a pattern which is printed in advance and has the predetermined density.

As this pattern which is printed in advance and has the predetermined density, a film generated by silver halide photography or the like which undergoes little change in density due to an environment and the like can be used. By comparing the density of each pattern with that of the pattern printed in advance and obtaining an ink combination exhibiting the predetermined density in this manner, the corresponding detecting operation can be done by a simple detection means. This method is also preferable from the viewpoint of simplifying the apparatus. In addition, if an ink-receiving member is formed on a film on which an image with a predetermined density is printed in advance is formed, and patterns are printed adjacent to each other on the film with several ink combinations, an ink combination exhibiting almost the same density as the predetermined density can also be selected by visual check.

Note that the predetermined density preferably falls, as an optical density, within the range of OD 0.5 to OD 2.0 in consideration of the sensitivity characteristics of visual check and a detection system, the accuracy of correction, and the like. If this density is excessively low, the accuracy of density correction in a high-density area decreases. If the density is excessively high, the sensitivity characteristics of visual check and the detection system deteriorate, resulting in difficulty in selection.

When the above converted value is to be converted into a density level (gray level value) in multilevel conversion processing, an appropriate function and table are used. It is preferable that functions and tables used for this conversion be prepared in accordance with the types of recording media, and be properly selected in accordance with the type of recording medium to be used. In addition, input image data is preferably made to correspond to this density level by setting an area used for conversion. For example, by using only a combination exhibiting a converted numerical value falling within the range of 0 to 2, printed images are always set to this value. In this case, a combination exhibiting a converted value of 2 or more is deleted from the ink distribution table. In addition, input image data can be made to correspond to this density level by enlarging/reducing the input image data in accordance with the target density.

As ink distribution tables, the following tables are conceivable: a table having only one combination of the types of inks and the numbers of ink droplets to be used in correspondence with each gray level value; and a table having two or more such combinations. An ink distribution table may be generated by a method of generating an entire table on the basis of input relative density ratios or a method of correcting and changing a prepared table. The present invention uses the method of correcting and changing a prepared table to shorten the time required to generate a table.

Assume that a table having only one combination of the types of inks and the numbers of ink droplets to be used in accordance with each gray level value is to be used. In this case, if there are a plurality of combinations exhibiting the same sum of relative density ratios, for example, a combination designated in advance in accordance with priority or the like is used while the remaining combinations are removed from the ink distribution table and are not used.

Assume that a table having two or more combinations of the types of inks to be used and the numbers of ink droplets in accordance with each gray level value is used. In this case, if there are a plurality of combinations exhibiting the same sum of relative density ratios, combinations exhibiting the same sum of relative density ratios are written along the combination designated in advance.

In this manner, an ink combination used for the ink distribution table is represented by a numerical value obtained by converting the sum of ink relative density ratios with reference to the sum of the relative density ratio of an ink combination exhibiting a predetermined density, and the converted numerical value is converted into a density level, thereby keeping the printing density almost constant regardless of the state (density) of ink used and obtaining a good grayscale image.

In the present invention, it is necessary to input ink relative density ratios. Such ink relative density ratios are determined by printing images by using inks having various densities and obtaining combinations exhibiting almost the same printing density. If, for example, four ink droplets with a dye concentration of 1% and one ink droplet with a dye concentration of 4% exhibit almost the same printing density, it is determined that the ink relative density ratio is 1:4.

In practice, if the numbers of ink droplets (ink discharge count) used to print one pixel differ, the resultant printing densities may differ. It is therefore preferable that printing densities be compared with each other after the ink discharge count is set. Note that this density comparison is performed by printing some test patterns. The comparison may be done by visual check or densitometer. That is, the comparison method is not specifically limited.

In addition, in the present invention, a criterion for determining a combination of the types of inks and the numbers of ink droplets to be used which is designated in advance to be preferentially used is not specifically limited. It is, however, preferable that a criterion be determined in consideration of density stability, resistance to the influences of "kink" and the like due to the discharge characteristics of each nozzle of a printing head, and the like.

Second Embodiment

A preferred embodiment according to the second aspect of the present invention will be described in detail below with reference to the accompanying drawings.

Note that the embodiment to be described below will exemplify the case wherein a chest X-ray medical image (12 bits: 4096 gray levels) is printed on a transmission type film by the ink-jet printer described with reference to the first embodiment upon setting O.D. max=2.5.

The same reference numerals as in the first embodiment denote the same parts in the second embodiment, and a description thereof will be omitted.

<Outline of Processing>

Figure 11:
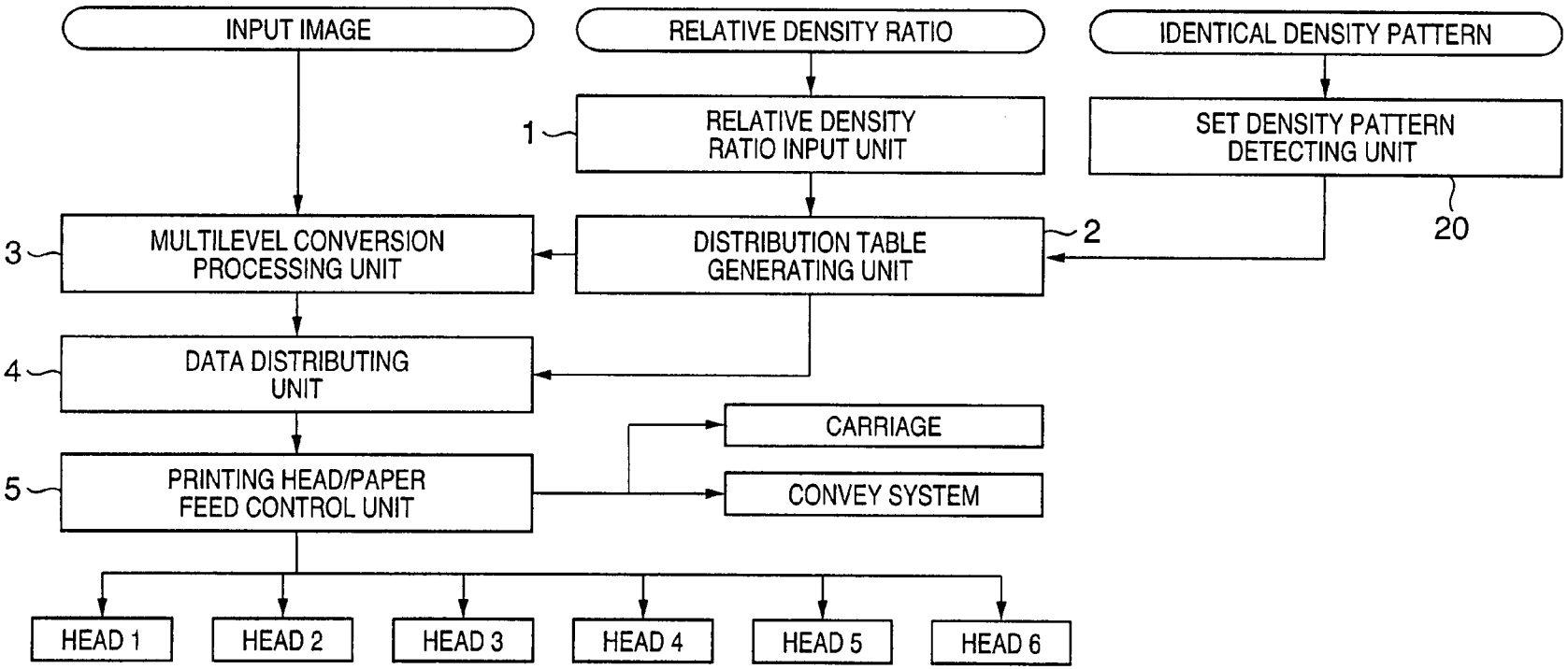
FIG. 11 is a functional block diagram showing an outline of processing in the second embodiment.

FIG. 11 is a functional block diagram showing an outline of processing in this embodiment. Reference numeral 1 denotes a relative density ratio input unit 1; 20, a set density pattern detecting unit; 2, a distribution table generating unit; 3, a multilevel conversion processing unit 3; 4, an ink distributing unit; and 5, a printing head/paper feed control unit.

<Inputting of Relative Density Ratios>

The relative density ratio input unit 1 outputs ink relative density ratios to the distribution table generating unit 2. Ink relative density ratios may be determines, as needed, for example, after a printing head is replaced or a predetermined period of time elapses, or when the user feels that grayscale quality has deteriorated or the printing head has not been used for a long period of time. This determination need not always be performed before the image printing operation.

The relative density ratio input unit 1 has an ink relative density ratio memory for storing/holding ink relative density ratio data that has been determined most recently. When new ink relative density ratios are determined, the contents of the memory are updated. When no new ink relative density ratios are determined, the values held in the memory are output to the distribution table generating unit 2.

<Determination of Relative Density Ratios and Detection of Set Density Pattern>

The set density pattern detecting unit 20 is a section for detecting an ink combination pattern exhibiting a predetermined value when its density is measured under a predetermined condition, e.g., in terms of optical density or the like. In this embodiment, this section detects a combination exhibiting optical density O.D.=1.5.

Figure 12:
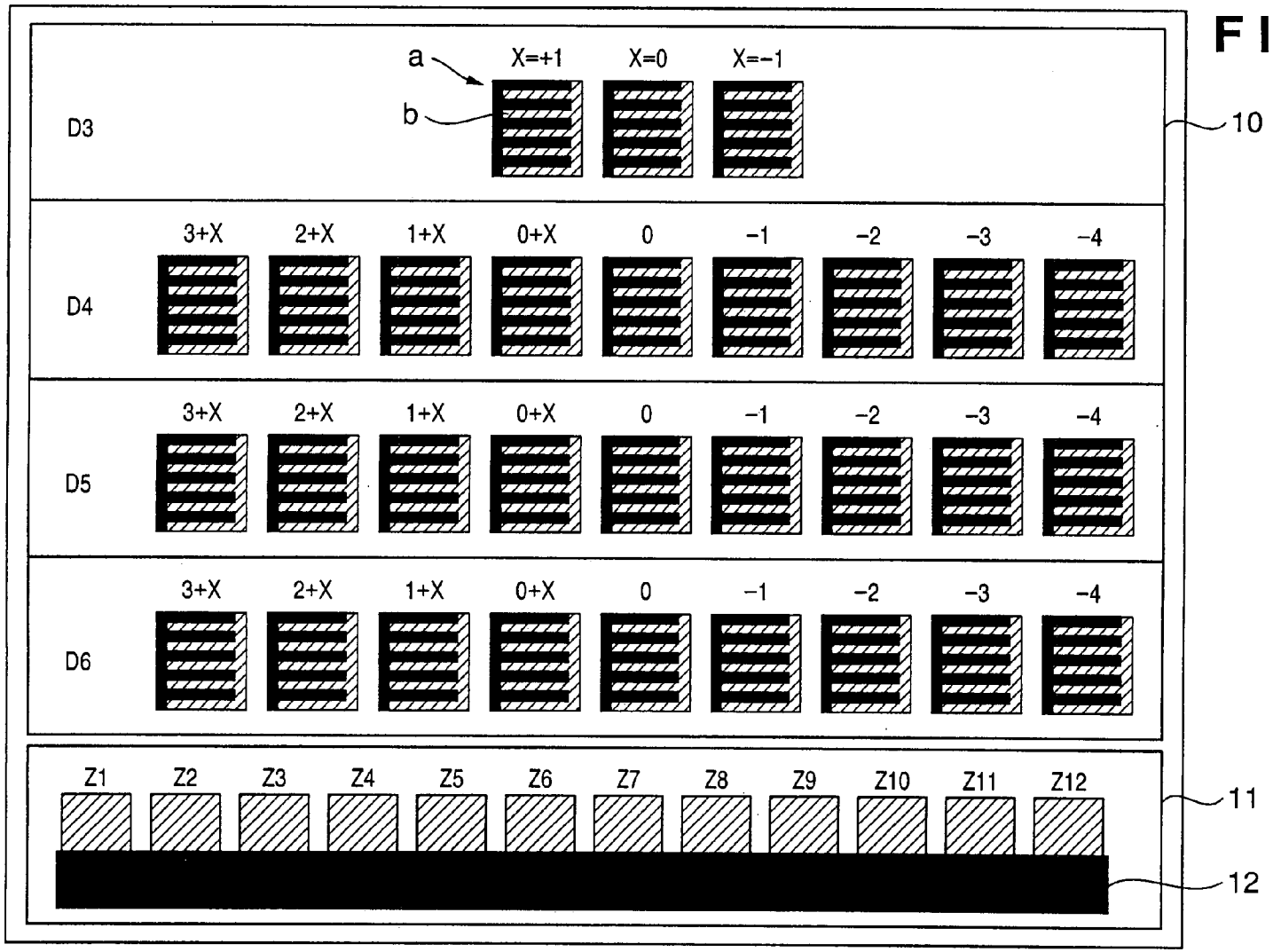
FIG. 12 is a view showing a test pattern for determining relative density ratios and detecting a set density.

FIG. 12 shows an example of a test pattern for determining ink relative density ratios and detecting an ink combination exhibiting O.D.=1.5. Referring to FIG. 12, reference numeral 10 denotes a pattern portion for determining ink relative density ratios; 11, a pattern for detecting a combination exhibiting O.D.=1.5; and 12, a portion printed in advance at optical density O.D.=1.5. The portions 10, 11, and 12 are formed on a transparent film.

Note that the test pattern in this embodiment is generated by forming the portion 12 on a silver halide film by exposure/developing, and then forming an ink-receiving member identical to CF-301 on the resultant structure.

The ink combinations used to print the relative density determination pattern 10 in FIG. 12 are the same as those shown in FIG. 3 described with reference to the first embodiment. FIG. 13 shows ink combinations used to print the pattern 11 for detecting a combination exhibiting O.D.=1.5 in FIG. 12. The numeral in each ink cell in FIG. 13 indicates the number of ink droplets used to print each pixel. In this embodiment, each portion is printed by four ink droplets.

The relative density determination pattern 10 shown in FIG. 13 is a density determination pattern for inks D3 to D6, and each of the numerals written on the respective rows indicates a value by which the relative density ratio of a target ink increases/decreases as compared with the corresponding dye concentration ratio shown in Table 1 when it is determined that the densities of the two areas are almost equal to each other. If, for example, it is determined with respect to ink D3 that the densities of the two areas of the portion with "0" are almost equal to each other, the relative density ratio of ink D3 is "4", which is equal to the dye concentration. If it is determined with respect to ink D4 that the densities of the two areas of the portion with "1+X" are almost equal to each other, the relative density ratio of ink D4 is dye concentration ratio+1, i.e., "9".

When the patterns in FIG. 12 were compared with each other by visual check, the densities of two areas were almost equal to each other at the following portions: "X=0" in row D3; "1+X" in row D4; "−1" in row D5; and "−1" in row D6. As a result, the relative density ratios of the respective inks were D1:D2:D3:D4:D5:D6=1:2:4:9:17:33. These values were input to the relative density ratio input unit 1.

When each portion of the pattern 11 was compared with the portion 12 printed at optical density O.D.=1.5, a portion Z11 was almost equal in density to the portion 12. As a consequence, Z11 is input to the set density pattern detecting unit 20.

The set density pattern detecting unit 20 obtains the sum of relative density ratios corresponding to input Z11. The obtained value is set as a reference (unit). As is obvious from FIG. 13, the portion Z11 is constituted by one droplet of ink D3, one droplet of ink D4, one droplet of ink D5, and one droplet of ink D6. The sum of the relative density ratios of a pattern corresponding to Z11 is calculated by referring to the memory in the relative density ratio input unit 1. The calculation result is 63.

In this embodiment, on the basis of this result, the sum of the relative density ratios of each ink combination is expressed in units of 63 (to be referred to as a density reference value hereinafter). The relationship between the sum of relative density ratios of inks used for printing and the optical density of the transparent film (CF-301) is given by $$O.D.=a_0+a_1dn+a_2dn^2+a_3dn^3+a_4dn^4 \quad (4)$$

where dn: the density reference value at O.D.=1.5, and $a_0$ to $a_4$: coefficients $a_0$=0.05, $a_1$=1.590, $a_2$=−0.062744, $a_3$=−0.094694, $a_4$=0.014022

Figure 14:
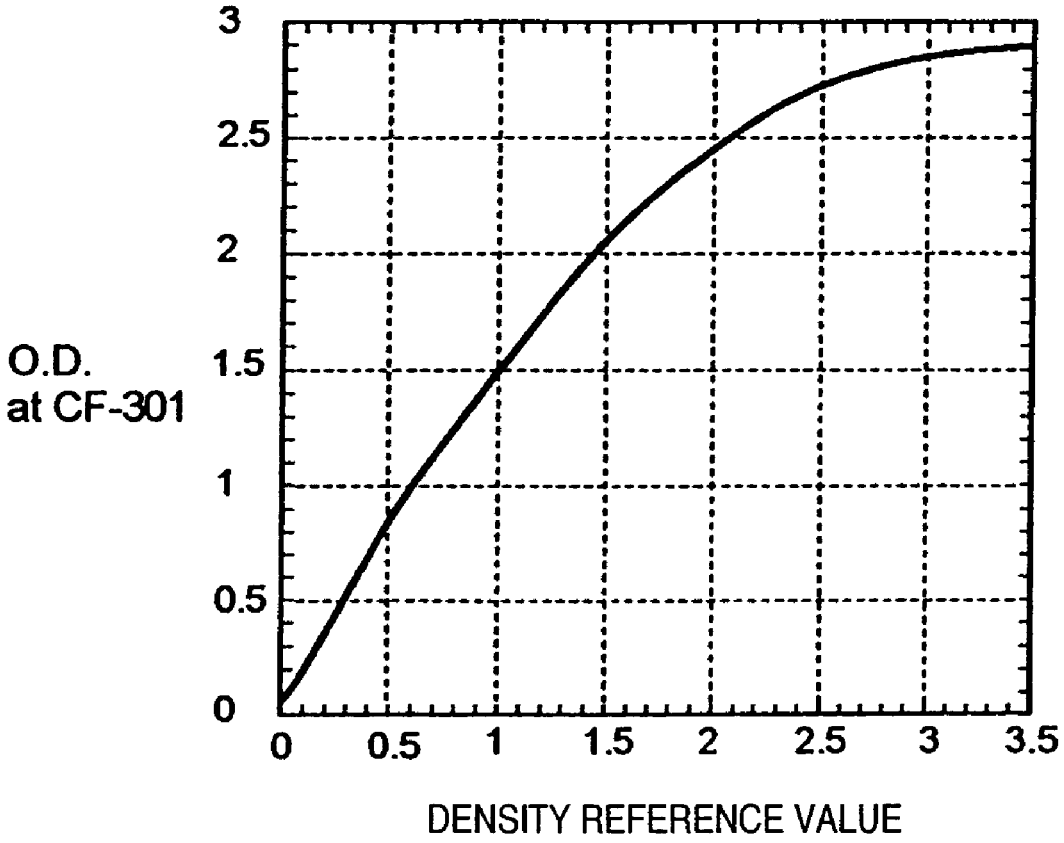
FIG. 14 is a graph showing the relationship between a density reference value and the optical density on CF-301 in the second embodiment.

FIG. 14 is a graph showing this relationship.

As is obvious from FIG. 14 and equation (4), when O.D. max=2.5 is set, the density reference value for an ink combination used in this embodiment falls within the range of 0 to 2.0865. That is, in this embodiment, the maximum value of input image data is 4095 because the image data is a 12-bit image. This value corresponds to 2.0865, the density reference value. Therefore, a 12-bit density level Level is given by $$\text{Level}=4095\{O.D.(dn)-O.D.(0)\}/\{2.5-O.D.(0)\} \quad (5)$$

<Generation of Distribution Table>

The distribution table generating unit 2 has an initial table memory in which some prepared combinations of the types of inks and the numbers of ink droplets are stored/held, together with their priority levels, and generates an ink distribution table by correcting/changing the table.

FIG. 15 is a view showing an example of the contents of the initial table memory in this embodiment. In this initial table, a total of 185 ink combinations are written, i.e., 68 ink combinations for which priority levels are set, and the 117 remaining ink combinations. Note that in the priority level cells in FIG. 15, smaller numerals indicate higher priority levels, and the blank cells indicate the remaining combinations.

The sum of relative density ratios is calculated for each combination. The calculated sum is then converted into a density reference value. The combinations written in the initial table are sorted according to this density reference value. If some combinations exhibit the same value, one that has a higher priority level (one with a smaller numeral in the priority level cell in FIG. 15) is written first so as to be mainly used. In addition, the other combination exhibiting the lower priority level and one of the remaining combinations which exhibits the same density reference value are written following the combinations which are mainly used. Each density reference value is converted into a density level according to equation (5).

FIG. 16 is a view showing part of the ink distribution table generated in this manner. Referring to FIG. 16, the combinations for which gray level values (density levels) are written are combinations that are mainly used, and each combination with a blank density level cell indicates that it has the same density level as that of the preceding combination. To set O.D. max=2.5, the density level with four droplets of ink D6, which represents the maximum density, became 4109. In addition, the total number of density levels in this embodiment was 57, and the total number of combinations used was 155.

When a distribution table having only one ink combination for each gray level value is to be used, only 56 ink combinations for which priority levels are set are stored/held in the initial table memory in the distribution table generating unit 2. In addition, if some combinations exhibit the same sum of relative density ratios, one exhibiting a lower priority level is deleted, and a density level is obtained by the remaining combinations, thereby generating an ink distribution table.

<Print Data Generation Processing>

The density levels in the ink distribution table obtained in the above manner are supplied to the multilevel conversion processing unit 3, and multilevel conversion processing of an input image is performed. Note that in this case, base-57 conversion processing was performed by using a general error diffusion method.

The data distributing unit 4 generates discharge data for each ink by using the data having undergone multilevel conversion processing and the distribution table.

A method of distributing ink for each pixel according to this embodiment will be described below. The data having undergone multilevel conversion processing is counted for each density level by a counter provided for each density level. If, for example, the data having undergone multilevel conversion processing is "584", a counter for density level 584 becomes $N_{584}$+=1.

As ink combinations (D1, . . . , D6) exhibiting density level "584", three kinds of ink combinations (1,2,0,1,0,0), (0,1,3,0,0,0), and (1,0,1,1,0,0) are provided by the ink distribution table. Therefore, the number of kinds of ink combinations exhibiting density level "584" is $K_{584}$=3. A determination is made by using these data in accordance with condition (6) given below, and whether mth combination of $K_{584}$=3 types of ink combinations is used is determined.

if ($N_{584}$% 4)

m=0;

else $$m=(N_{584}/4)\ \%\ (K_{584}-1)+1; \quad (6)$$

In (6), "%" is an operational sign indicating the remainder.

As a consequence, about 75% become m=0, and the main combination for this pixel, i.e., (1,2,0,1,0,0) in this case, is used. If m=1, the combination (0,1,3,0,0,0) is used. After an ink combination to be used for one pixel is determined in this manner, data are distributed for the respective inks in accordance with the combination.

The data distributed for the respective inks in the above manner are made to correspond to the nozzles of the printing head by the printing head/paper feed control unit 5, and are printed by driving the printing head in synchronism with the transfer system.

The image printed by the ink-jet printer according to this embodiment was free from gray-level reversal and the like and almost equal in quality to the image printed by a general medical laser imager.

Figure 17:
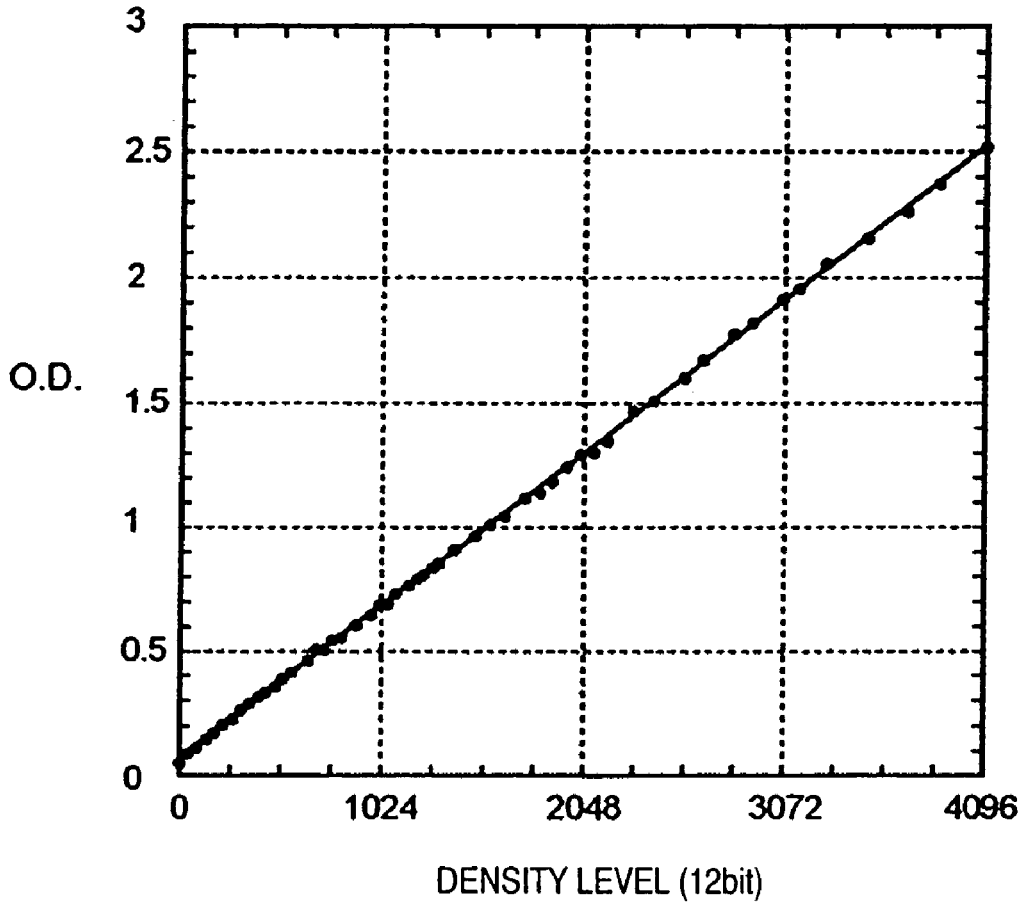
FIG. 17 is a graph showing the relationship between the density level and the optical density in the second embodiment.

In addition, in order to evaluate the result in this embodiment, patches each having a size of 200×200 pixels (about 8.5 $mm^2$) were printed in correspondence with 57 levels, i.e., the number of multilevel values, and the respective densities were measured. FIG. 17 is a graph showing the result. As is obvious from this result as well, no density reversal occurred among the respective levels. In addition, when the relationship between the density level and the optical density was approximated by a straight line, R=0.99977, an excellent correlation coefficient, was obtained.

Third Embodiment

The system used in the second embodiment was left to stand for about three weeks, and then the same processing as that in the second embodiment was performed to print a chest X-ray medical image (12 bits: 4096 gray levels) on a transmission type film upon setting O.D. max=2.5.

In order to determine an ink relative density ratio and an ink combination pattern exhibiting optical density O.D.=1.5, the pattern shown in FIG. 12 was printed on the transparent film CF-301. When the rows corresponding to the respective inks were compared by visual check to obtain relative density ratios as in the first embodiment, the densities of two areas were almost equal to each other at the following portions: "X=0" in row D3; "1+X" in row D4; "−2" in row D5; and "−2" in row D6. As a result, the relative density ratios of the respective inks were D1:D2:D3:D4:D5:D6=1:2:4:9:17:33.

In addition, in order to determine an ink combination pattern exhibiting optical density O.D.=1.5, a portion 12 with the reference density (O.D.=1.5) formed from a silver halide film and recorded patterns Z1 to Z12 were compared with each other by using an optical detection system constituted by an LED and photodiode. As a result, the pattern Z6, i.e., the portion printed with the combination (0, 0, 2, 1, 0, 1) as the ink combination (D1, . . . , D6) was almost equal in density to the portion 12. The sum of the relative density ratio of this ink combination, i.e., a unit of density reference value, was 47.

FIG. 18 is a view showing part of the ink distribution table generated in this manner. In this ink distribution table, the total number of density levels is 55, and the total number of combinations is 141. The portion indicated by "c" in FIG. 18 may be omitted because there are no corresponding input values (12 bit: 0 to 4095).

Multilevel conversion processing substantially corresponding to base-53 was performed by using this distribution table, and an ink combination to be used for one pixel was determined. Data were then distributed for the respective inks according to this combination to print an image. The resultant image was free from gray-level reversal and the like and almost equal in quality to the image printed by a general medical laser imager.

Figure 19:
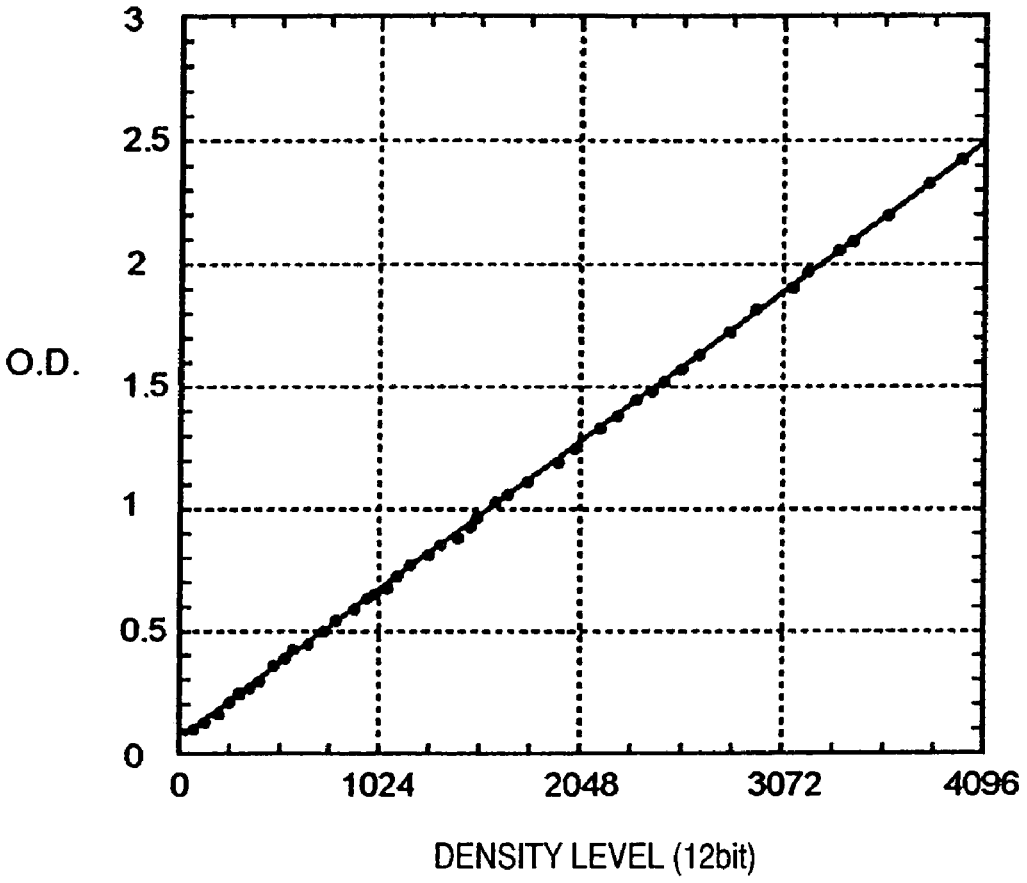
FIG. 19 is a graph showing the relationship between the density level and the optical density in the third embodiment.

In addition, in order to evaluate the result in this embodiment, patches were printed for 51 levels, the number of multilevel values, in the same manner as in the second embodiment, and the respective densities were measured. FIG. 19 is a graph showing the result. As is obvious from this result as well, no density reversal occurred among the respective levels. In addition, when the relationship between the density level and the optical density was approximated by a straight line, R=0.99984, an excellent correlation coefficient, was obtained.

Fourth Embodiment

The system used in the third embodiment was further left to stand for about one month, and then the same processing as that in the first embodiment was performed to print a chest X-ray medical image (12 bits: 4096 gray levels) on a transmission type film upon setting O.D. max=2.5.

In order to determine an ink relative density ratio and an ink combination pattern exhibiting optical density O.D.=1.5, the pattern shown in FIG. 12 was printed on the transparent film CF-301. When the rows corresponding to the respective inks were compared by visual check to obtain relative density ratios as in the first embodiment, the relative density ratios of the respective inks were D1:D2:D3:D4:D5:D6=1:2:4:8:15:28.

In addition, in order to determine an ink combination pattern exhibiting optical density O.D.=1.5, a portion 12 with the reference density O.D.=1.5) formed from a silver halide film and recorded patterns Z1 to Z12 were compared with each other by using an optical detection system constituted by an LED and photodiode. As a result, the pattern Z2, i.e., the portion printed with the combination (0, 2, 1, 0, 0, 1) as the ink combination (D1, . . . , D6), was almost equal in density to the portion 12. The sum of the relative density ratio of this ink combination, i.e., a unit of density reference values, was 36.

FIG. 20 is a view showing part of the ink distribution table generated in this manner. Note that this embodiment used an ink distribution table containing only one combination of the types of inks and the numbers of ink droplets to be used for one gray level value. In this ink distribution table, the total number of density levels is 55. The portion indicated by "d" in FIG. 20 may be omitted because there are no corresponding input values (12 bit: 0 to 4095).

Multilevel conversion processing substantially corresponding to base-51 was performed by using this distribution table, and an ink combination to be used for one pixel was determined. Data were then distributed for the respective inks according to this combination to print an image. The resultant image was free from gray-level reversal and the like and almost equal in quality to the image printed by a general medical laser imager.

Figure 21:
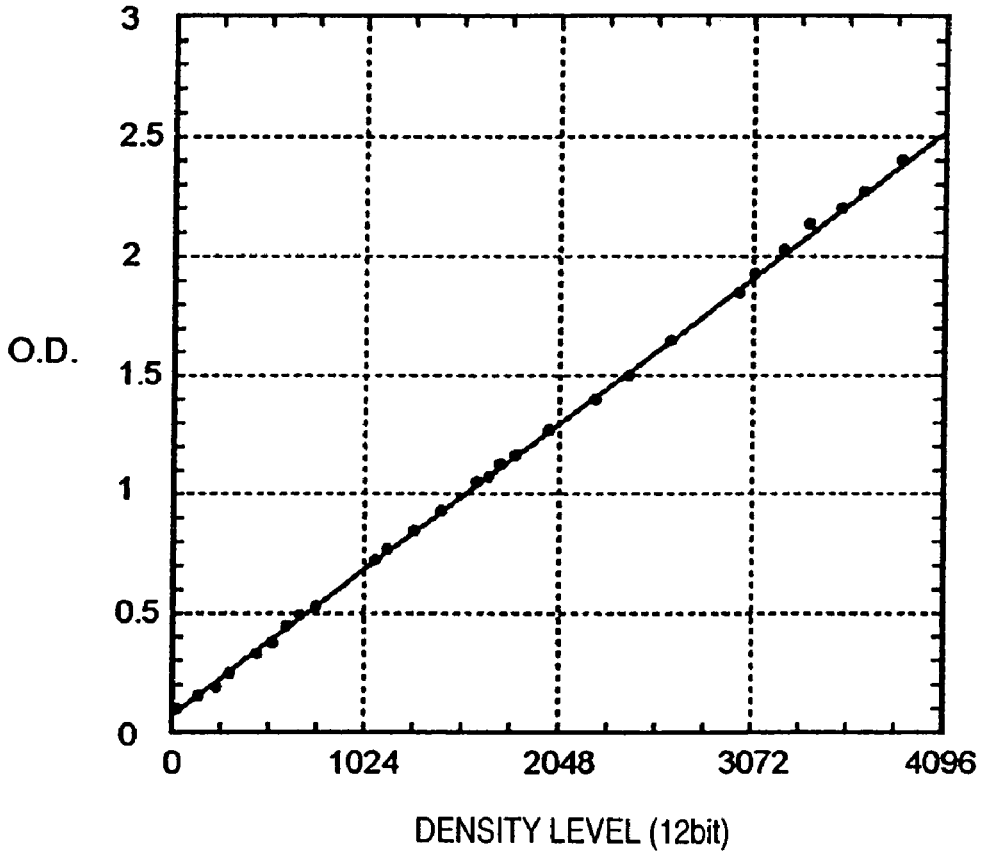
FIG. 21 is a graph showing the relationship between the density level and the optical density in the fourth embodiment.

In addition, in order to evaluate the result in this embodiment, patches were printed for 51 levels, the number of multilevel values, in the same manner as in the second embodiment, and the respective densities were measured. FIG. 21 is a graph showing the result. As is obvious from this result as well, no density reversal occurred among the respective levels. In addition, when the relationship between the density level and the optical density was approximated by a straight line, R=0.99983, an excellent correlation coefficient, was obtained.

According to the second to fourth embodiments, as is also obvious from the graphs of FIGS. 17, 19, and 21, it was confirmed that printing was performed at the same density with respect to the same gray level value.

Comparative Examples of Second Aspect of Present Invention

As comparative examples of the second to fourth embodiments described above, only processing for obtaining ink relative density ratios was performed, and images were printed without performing processing for detecting an ink combination exhibiting a predetermined density. As a result, although the three types of images were free from gray-level reversal and the like, differences in density among solid portions and the like could be recognized even by visual check, giving different impressions.

Figure 22:
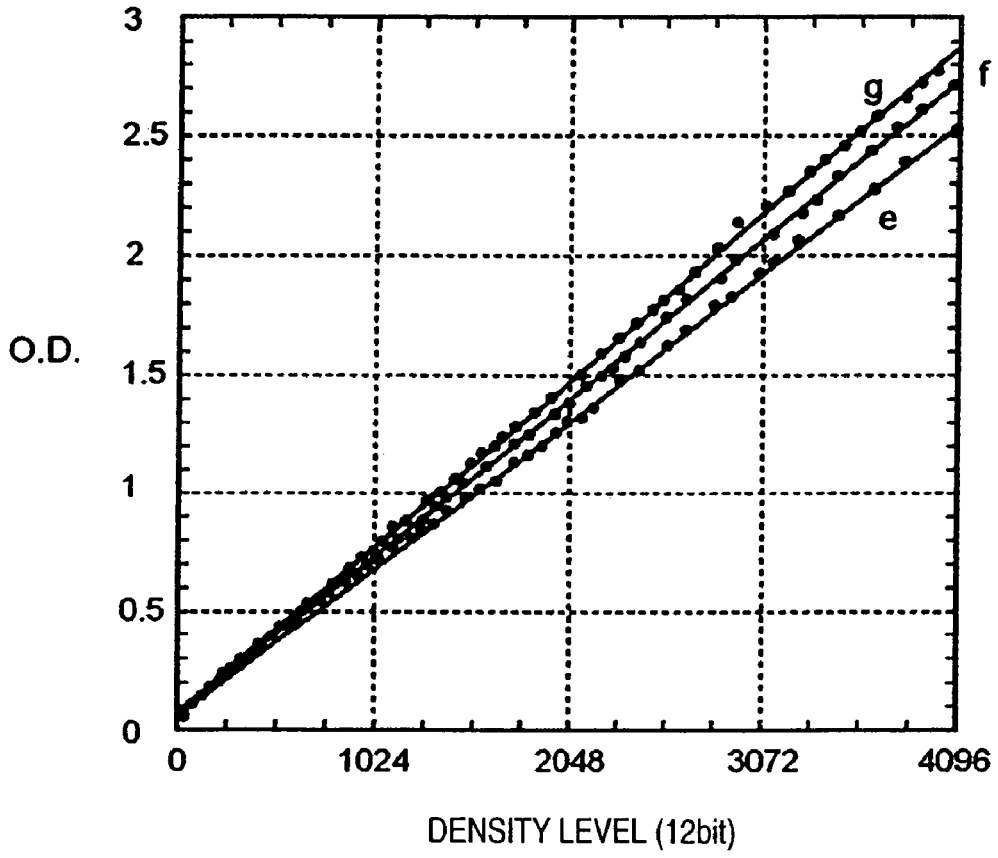
FIG. 22 is a graph showing the relationship between the density level and the optical density in a comparative example of the second aspect of the present invention.

FIG. 22 is a graph showing the result obtained by printing patches and measuring their densities as in the second to fourth embodiments. Referring to FIG. 22, a line e represents printing performed simultaneously with that in the second embodiment, and lines f and g correspond to the third and fourth embodiments, respectively.

As is obvious from this graph as well, the printing density with respect to the same density level changed depending on the state of ink in printing operation, and hence no identical images could be obtained.

Other Embodiment

The above embodiments use the general error diffusion method in multilevel conversion processing. However, as a multilevel conversion processing method in the present invention, various multilevel conversion methods such as a multilevel error diffusion method and multilevel dither matrix method can be used, and is not specifically limited.

The ink-jet printing method used in the present invention can be applied to any conventional known ink-jet printing scheme of printing images by discharging ink droplets from nozzles by using various driving principles. The ink-jet scheme disclosed in Japanese Patent Laid-Open No. 54-59936 is a typical example, in which ink undergoes an abrupt volume change upon receiving the effect of heat energy, and is discharged from a nozzle with the acting force produced by this state change.

As the typical arrangement and principle of the ink-jet printing system, those practiced by use of the basic principle disclosed in, for example, U.S. Pat. Nos. 4,723,129 and 4,740,796 is preferable. The above system is applicable to either one of so-called on-demand type and continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal.

By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note further that excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification, or the arrangement as a single printhead obtained by forming printheads integrally can be used.

In addition, not only an exchangeable chip type printhead, as described in the above embodiment, which can be electrically connected to the apparatus main unit and can receive ink from the apparatus main unit upon being mounted on the apparatus main unit, but also a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

The present invention can be applied to a system comprising a plurality of devices (e.g., host computer, interface, reader, printer) or to an apparatus comprising a single device (e.g., copying machine, facsimile machine).

Further, the object of the present invention can also be achieved by providing a storage medium storing program codes for performing the aforesaid processes to in a computer system or apparatus (e.g., a personal computer), reading the program codes, by a CPU or MPU of the computer system or apparatus, from the storage medium, then executing the program. In this case, the program codes read from the storage medium realize the functions according to the embodiments, and the storage medium storing the program codes constitutes the invention. Furthermore, besides the aforesaid functions according to the above embodiments being realized by executing the program codes which are read by a computer, the present invention also includes a case where an OS (operating system) or the like working on the computer performs parts of or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, a CPU or the like contained in the function expansion card or unit performs a part of or entire processes in accordance with designations of the program codes and realizes functions of the above embodiments.

If the present invention is realized as a storage medium, program codes corresponding to the above mentioned function blocks (FIG. 1 and/or FIG. 11) are to be stored in the storage medium.

As is apparent, many different embodiments of the present invention can be made without departing from the spirit and scope thereof, so it is to be understood that the invention is not limited to the specific embodiments thereof except as defined in the appended claims.

What is claimed is:

1. An ink-jet printing apparatus which performs multilevel printing by using a plurality of types of inks having different densities for similar colors when used for printing, and changing the types of inks and the numbers of ink droplets in printing each pixel, comprising:

input means for inputting information associated with relative densities for the respective inks in case of being used for printing;

table generation means for generating, on the basis of the information associated with the relative densities, an ink distribution table for defining a combination of the types of inks and the numbers of ink droplets in correspondence with each gray level value;

combination selection means for selecting, on the basis of the ink distribution table, the combination to be used to print each pixel, wherein the ink distribution table defines a plurality of combinations of the types of inks and numbers of the ink droplets for some grey level value; and reference combination input means for inputting a combination of the types of inks and the numbers of ink droplets which exhibit a predetermined density as a reference combination, wherein said table generation means generates, on the basis of information associated with the relative densities and the reference combination, the ink distribution table which defines a correspondence between various combinations of the types of inks and the numbers of ink droplets and gray level values printed by the respective combinations, wherein said table generation means includes reference value calculating means for expressing the sum of the ratios with respect to ink droplets contained in each combination as a density reference value with respect to the sum of the ratios with respect to ink droplets contained in the reference combination, and conversion means for converting the density reference value into the gray level value.

2. The apparatus according to claim 1, wherein the information associated with the relative densities of the respective inks is expressed by a ratio with a density of ink having a lowest density being regarded as 1.

3. The apparatus according to claim 2, wherein said table generation means includes sum calculating means for calculating the sum of the ratios with respect to ink droplets contained in each combination, and gray level calculating means for obtaining a gray level value corresponding to the sum of the ratios.

4. The apparatus according to claim 3, further comprising a plurality of printing heads for discharging ink by using heat energy in correspondence with the plurality of types of inks.

5. The apparatus according to claim 1, further comprising test pattern generating means with various combinations of the types of inks and the numbers of ink droplets on a printing medium having a portion which is printed in advance at the predetermined density.

6. The apparatus according to claim 1, wherein the predetermined density falls within a range of 0.5 to 2.0 in terms of optical density.

7. An ink-jet printing method which performs multilevel printing by using a plurality of types of inks having different densities for similar colors when used for printing, and changing the types of inks and the numbers of ink droplets in printing each pixel, comprising:

an input step of inputting information associated with relative densities for the respective inks in case of being used for printing;

a table generating step of generating, on the basis of the information associated with the relative densities, an ink distribution table for defining a combination of the types of inks and the numbers of ink droplets in correspondence with each gray level value;

a combination selection step of selecting the combination to be used to print each pixel on the basis of the ink distribution table, wherein the ink distribution table defines a plurality of combinations of the types of inks and numbers of the ink droplets for some grey level; and a reference combination input step of inputting a combination of the types of inks and the numbers of ink droplets which exhibit a predetermined density as a reference combination, wherein in the table generating step, on the basis of information associated with the relative densities and the reference combination, the ink distribution table is generated which defines a correspondence between various combinations of the types of inks and the numbers of ink droplets and gray level values printed by the respective combinations, wherein the table generating step includes a reference value calculating step of expressing the sum of the ratios with respect to ink droplets contained in each combination as a density reference value with respect to the sum of the ratios with respect to ink droplets contained in the reference combination, and a conversion step of converting the density reference value into the gray level value.

8. The method according to claim 7, wherein in the table generating step, the ink distribution table is generated by using an initial table in which a predetermined number of combinations are defined, and a combination to be preferentially selected in the combination selection step is designated.

9. The method according to claim 7, wherein the information associated with the relative densities of the respective inks is expressed by a ratio with a density of ink having a lowest density being regarded as 1.

10. The method according to claim 9, wherein the table generating step includes a sum calculating step of calculating the sum of the ratios with respect to ink droplets contained in each combination, and a gray level calculating step of obtaining a gray level value corresponding to the sum of the ratios.

11. The method according to claim 7, further comprising a test pattern generating step of printing a predetermined pattern with various combinations of the types of inks and the numbers of ink droplets on a printing medium having a portion which is printed in advance at the predetermined density.

12. The method according to claim 7, wherein the predetermined density falls within a range of 0.5 to 2.0 in terms of optical density.

13. The method according to claim 7, wherein in the table generating step, the ink distribution table is generated by using an initial table in which a predetermined number of combinations are defined, and a combination to be preferentially selected in the combination selection step is designated.

* * * * *

UNITED STATES PATENT AND TRADEMARK OFFICE

CERTIFICATE OF CORRECTION

PATENT NO. : 7,070,253 B2
APPLICATION NO. : 10/932112
DATED : July 4, 2006
INVENTOR(S) : Yashima et al.

It is certified that error appears in the above-identified patent and that said Letters Patent is hereby corrected as shown below:

COLUMN 6:
Line 48, “optical-density” should read --optical density--.

COLUMN 10:
Line 28, “new” should read --a new--.

COLUMN 12:
Line 14, “O.D. = $a_0+a_1+d+a_2d^2+a_3d^3a_4d^4$ (1)” should read --O.D. = $a_0+a_1d+a_2d^2+a_3d^3+a_4d^4$ (1)--.

COLUMN 13:
Line 36, “Comperative” should read --Comparative--.

COLUMN 16:
Line 12, “determines,” should read --determined,--.

COLUMN 20:
Line 21, “O.D. = 1.5)” should read --(O.D. = 1.5)--.

COLUMN 22:
Line 41, “to” should be deleted.

UNITED STATES PATENT AND TRADEMARK OFFICE

CERTIFICATE OF CORRECTION

PATENT NO. : 7,070,253 B2
APPLICATION NO. : 10/932112
DATED : July 4, 2006
INVENTOR(S) : Yashima et al.

It is certified that error appears in the above-identified patent and that said Letters Patent is hereby corrected as shown below:

COLUMN 24 CLAIM 7:

Line 14, "level;" should read --level values;--.
Line 34, "wherein" should read --wherein,--.
Line 58, "wherein" should read --wherein,--.

Signed and Sealed this

Twentieth Day of May, 2008

JON W. DUDAS
*Director of the United States Patent and Trademark Office*